US008905731B2

(12) United States Patent
Baron

(10) Patent No.: US 8,905,731 B2
(45) Date of Patent: Dec. 9, 2014

(54) LINEAR PERISTALTIC PUMP

(75) Inventor: Rick Baron, Zephyrhills, FL (US)

(73) Assignee: Nestec S.A., Vevey (CH)

( * ) Notice: Subject to any disclaimer, the term of this patent is extended or adjusted under 35 U.S.C. 154(b) by 0 days.

(21) Appl. No.: 14/239,212

(22) PCT Filed: Aug. 3, 2012

(86) PCT No.: PCT/EP2012/065250
§ 371 (c)(1),
(2), (4) Date: Apr. 3, 2014

(87) PCT Pub. No.: WO2013/023939
PCT Pub. Date: Feb. 21, 2013

(65) Prior Publication Data

US 2014/0212314 A1 Jul. 31, 2014

Related U.S. Application Data

(60) Provisional application No. 61/575,233, filed on Aug. 17, 2011.

(51) Int. Cl.
*F04B 43/12* (2006.01)
*A61M 1/00* (2006.01)

(52) U.S. Cl.
CPC ..... *F04B 43/1276* (2013.01); *F04B 43/1223* (2013.01)
USPC ..... 417/477.6; 417/53; 604/153

(58) Field of Classification Search
CPC ..... F04B 43/1276
USPC ..... 417/477.6, 477.7, 477.11, 477.12
See application file for complete search history.

(56) References Cited

U.S. PATENT DOCUMENTS

| | | | | |
|---|---|---|---|---|
| 2,696,173 | A | 12/1954 | Jensen | |
| 7,384,600 | B2 * | 6/2008 | Burns et al. | 422/64 |
| 2005/0129545 | A1 * | 6/2005 | Prosek, Jr. | 417/474 |
| 2005/0163637 | A1 | 7/2005 | Chang et al. | |
| 2006/0228240 | A1 | 10/2006 | Schroeder et al. | |
| 2013/0045122 | A1 * | 2/2013 | Zupp et al. | 417/477.11 |

FOREIGN PATENT DOCUMENTS

GB 2138511 10/1984

OTHER PUBLICATIONS

International Search Report for International Application No. PCT/EP2012/065250 mailed on Oct. 25, 2012.
International Preliminary Report on Patentability for corresponding International Application No. PCT/EP2012/065250 mailed on Feb. 27, 2014.

* cited by examiner

*Primary Examiner* — Charles Freay
*Assistant Examiner* — Christopher Brunjes
(74) *Attorney, Agent, or Firm* — K&L Gates LLP

(57) ABSTRACT

Linear peristaltic pump for pumping a fluid through a flexible tube (13) comprises a rotatable central member (34) with a plurality of radially disposed planetary gears (51-53). An offset roller (61-63) is disposed on each of the planetary gears (51-53). The flexible tube (13) is inserted between a generally flat compression surface (40) and at least one of the plurality of rollers (61-63). Rotation of the central member (34) enables the plurality of rollers (61-63) to serially collapse the flexible tube (13) and to move in a substantially linear motion along the generally flat compression surface (40) for pumping the fluid through the flexible tube (13).

16 Claims, 17 Drawing Sheets

LINEAR PERISTALTIC PUMP

CROSS REFERENCE TO RELATED APPLICATIONS

The present application is a National Stage of International Application No. PCT/EP2012/065250, filed on Aug. 3, 2012, which claims priority to U.S. Provisional Patent Application No. 61/575,233, filed Aug. 17, 2011, the entire contents of which are being incorporated herein by reference.

FIELD OF THE INVENTION

This invention relates to pumps and more particularly to an improved linear peristaltic pump

BACKGROUND OF THE INVENTION

The peristaltic pump was developed in the 1930's by a medical student, who later became a noted heart surgeon. He recognized the need for a positive displacement pump which would negate cross contamination between the pump mechanism and sterile fluids. Progression of the art eventually led to three basic types of peristaltic pumps.

In a rotary peristaltic pump, fluid in a flexible tube is contained within a circular pump housing along in its internal circumferential area. A revolving series of rollers compresses and closes the tube, forcing the fluid ahead of the roller to be moved out of the pump exit and the tubing immediately following the roller to be returned to its normal expanded state (process called peristalsis), thereby drawing fluid into the pump through the pump inlet.

In a circular peristaltic pump, a single roller on an eccentric compresses the tubing through a full 360 degrees of rotation. This is accomplished by a roller with increased width contacting the slightly spiraled tubing within the pump housing.

Linear peristaltic pumps have typically used a series of sequential cam driven fingers to effect the peristaltic pumping action. Some variations to the linear peristaltic pump actions include systems which compress the tube between a flat platen and a series of belt mounted rollers which are successively driven along the platen. Another variation of a linear peristaltic pump attempts to utilize the traditional circular roller motion to achieve a linear pump. In this pump, a pair of shaft mounted rollers interacts with the tubing affixed to a spring loaded pivotal pump arm which moves under the influence of the rollers. As the rollers reach a position in which they are not occluding the tubing a fixed stop device occludes the tube, thereby preventing any back or forward flow until the next cycle of rollers contacts and occludes the tubing. The problem of combining the simplicity of the circular mechanism in a linear peristaltic pump has remained unanswered.

There have been many in the prior art who have attempted to solve these problems with varying degrees of success. None, however completely satisfies the requirements for a complete solution to the aforestated problem. The following U.S. patents are attempts of the prior art to solve this problem.

U.S. Pat. No. 2,446,618 to Stocks discloses pumps which are particularly suitable for use in moving sludges, slimes, and other fluids carrying a large amount of solids. The invention teaches a pump in which the pressure chamber is collapsed progressively, and continuously in the direction of he flow of the material being pumped.

U.S. Pat. No. 3,249,059 to Renn discloses a new and improved peristaltic pump. The invention teaches a new and improved means for supporting and guiding the planetary roller assembly which compresses the length of collapsible tubing.

U.S. Pat. No. 3,366,071 to Dutler discloses a peristaltic or tube squeezing pump of the planetary type, i.e. it has rollers without individual bearings and contacting a central driving member which preferably is circular. The rollers are arranged to roll on the tube and on a rolling face along different portions of their travel. In each roller the portion contacting the tube has a slightly greater diameter than the portion contacting the rolling surface so that a slight recoil movement of the tube contacting portion is produced while the roller is rolling on the rolling face.

U.S. Pat. No. 3,876,340 to Thomas discloses a peristaltic pipe in which there are several side-by-side flexible pumping tubes each having its own set of pumping rollers which are moved sequentially into a tube flattening position, along the tube for a predetermined length and then cut out of contact with the tube to perform the pumping action. Each tube has its own support against which it is pressed by the rollers and the support is resiliently yieldable in order to avoid placing excess flattening pressures on the tube. In a preferred case, each support is a spring loaded block which may be of resilient material, each set of rollers is carried on a rotatable spider, and the spiders are rotatable simultaneously.

U.S. Pat. No. 4,165,954 to Amos discloses a linear peristaltic pump. The pump includes a pivotal pump arm and a flexible tube secured thereto to inhibit longitudinal tube movement. A means for applying a force to such arm, such as a spring, is provided to cause the pump arm to pivot. A stop device is disposed in the path of travel of the pump arm so that the pump arm pivotal travel may be terminated as the pump arm comes to rest against such stop device. The flexible tube is disposed adjacent a surface of the pump arm and is pivotal therewith so that the flexible tube is pinched off between the pump arm surface and the stop device as the pump comes to rest against it. A rotatable roller assembly is provided having at least one roller mounted on a rotatable roller support. The roller intermittently contacts the flexible tube as the roller support is rotated causing a quantity of liquid to be peristaltically moved within the tube. The pump arm may have a concave surface to accommodate the flexible tube and the convex surface of the roller, if desired. The stop device may be adjustable so as to permit adjustment and change of the pivotal travel of the pump arm. The rotatable roller assembly may be caused to intermittently contact the flexible tube through the use of an electric clutch to which the roller assembly is rotatably responsive. The rotatable roller assembly causes the pump arm and flexible tube to pivot in a direction away from the stop device while the means for applying a force causes the pump arm and flexible tube to pivot in a direction towards the stop device.

U.S. Pat. No. 4,493,706 to Borsanyi et al. discloses a linear peristaltic pump, and a disposable cassette therefore, particularly suitable for the infusion of parenteral fluids. The pump includes a housing having a power-driven shaft and a series of small bearing assemblies having their inner members eccentrically mounted upon that shaft. A thin elastomeric membrane extends along the series of bearing assemblies for engagement with the outer members thereof along a first band or linear zone of contact lying in the same plane as the axis of the shaft. The disposable cassette is removably supported by the housing and takes the form of a rigid, planar, parametric frame having an opening across which is stretched a section of elastomeric tubing. Locators provided by the housing and frame orient the cassette with the axis of the tubing in the same plane as the first band of contact and the axis of the shaft, and a platen provided by the housing engages the section of elastomeric tubing that bridges the opening of the frame to urge that section into engagement with the opposite side of the membrane along a second band or linear zone of contact parallel with the first band of contact. The cassette may include tubular extensions and connectors for connecting opposite ends of the section of elastomeric tubing to a source of fluid and to a patient.

U.S. Pat. No. 4,715,435 to Foret discloses a method and apparatus for pumping and exchanging heat at an accelerated rate between two fluid streams. The apparatus comprises opposite peristaltic pumps moving a separate fluid on their respective side of a linear heat-conductive platen. Each pump consists of a flat elastomeric diaphragm clamped by its edges on the platen; the clamping squeeze displaces the elastomer and makes the diaphragm bulge. Closely spaced pins in combination with fixed cams, flatten and contract the bulge across to form a variable cross-section working chamber. Inlet and outlet are formed by the elastomer bulging into end block cavities leading to ports. In a typical operation, conveyed rollers depress the pins which in turn completely contract the bulge to sealing contact with the platen and forms shrinking volumetric chambers, wherein a gas or mixed-phase fluid is compressed progressively on one side of the platen; on the other side similar operation occurs but volumetric chambers circulate a non-compressible liquid. During operation, heat of compression is simultaneously rejected to the cooling liquid through the platen to achieve a near-isothermal process.

U.S. Pat. No. 4,921,477 to Davis discloses a surgical irrigation and aspiration system for aspirating fluid from a surgical site, such as the eye, including a surgical tool having irrigation and aspiration functions, and an irrigation fluid supply for providing irrigation fluid to the surgical tool. A peristaltic pump pumps aspiration fluid from the surgical site generally through and away from the surgical tool and through an aspiration flow line to a collection container. A dampening mechanism in the aspiration flow line before the pump dampens the oscillations of the aspiration fluid flow, caused by the inherent operation of the peristaltic pump, in the aspiration flow line, and thereby at the surgical site.

U.S. Pat. No. 5,044,902 to Malbec discloses a cartridge comprised of a housing which comprises, in the vicinity of each of its ends, a cylindrical raceway against which are capable of applying and rolling bevel gears which crush the flexible tube located between both raceways. The bevel gears are tubular and freely mounted inside the housing, within the concavity of the flexible tube, this housing comprising, at least on one side, a central opening with a diameter large enough to enable the driving of the bevel gears either directly from a rotary disc provided with planet gears capable of engaging into the tubular bevel gears or from a shaft internally engaged between the tubular bevel gears.

U.S. Pat. No. 5,054,947 to Frank, et al. discloses a self-contained power painting system in which a battery operated motor and pump are contained in a lid for a paint reservoir, and that entire unit is adapted to be carried on a user by a strap or belt. A paint applicator, such as a brush or roller, is connected to the pump by a flexible conduit and includes a switch activator at the applicator to permit the user to selectively control operation of the pump and to move about freely while painting without being encumbered by a relatively immobile paint reservoir or power source connection through extension cords.

U.S. Pat. No. 5,096,393 to Van Steendren, et al. discloses a peristaltic metering pump for dosing metered quantities of fluids along a plurality of flow lines. The pump comprises a set of rollers and a plurality of flexible liquid transfer tubes, the tubes being mounted on a tube mounting against which they are simultaneously compressed by the rollers. The rollers are drivingly connected to a motor, the rollers being mounted on a roller support. The motor is operable to drive the rollers so that they roll successively along the tubes and compress the tubes simultaneously against the tube mounting as they roll along the tubes. The roller support is biassed against a stop with the roller support being movable away from the stop against the bias by force exerted on at least one roller by the tubes.

U.S. Pat. No. 5,924,852 to Moubayed et al. discloses a peristaltic pump for pumping liquids through a resilient tube. In one embodiment, the pump includes a curved concave platen against which a resilient tube is placed. A multi lobed cam is positioned adjacent to the platen and tube. A plurality of pump fingers are mounted between tube and cam in a manner permitting radial movement of the pump fingers. As the cam rotates, the fingers are pressed toward the tube sequentially so as to pump liquid through the tube. The lobe end should press the tube sufficiently to occlude the tube and prevent back flow without over pressing and damaging the tube. A transverse pinch finger is provided on each pump finger, extending from the tube pressing face of each pump finger. At the tube occluding position, the pump finger nearly occludes the tube and the pinch finger completes occlusion without pressing the tube beyond the fully occluded position. A fixed or slidable spring pressed pinch finger may be used. In a second embodiment, the pump fingers also include pinch fingers and are moved toward and away from a planar platen by a plurality of cams mounted transversely on a rotatable shaft. The pinch fingers operate in the same manner as in the first embodiment.

U.S. Patent Application 2006/0228240 to Schroeder, et al. discloses a method and accompanying apparatus for dispensing product with a non-invasive linear peristaltic pump. The linear peristaltic pump includes a traction plate having a linear portion, a depressor and a driver. The depressor compresses the product tube between the linear portion and the depressor, such that an inner passage of the product tube is substantially sealed. The driver moves the depressor along the linear portion of the traction plate, such that the product tube located between the depressor and the linear portion is compressed along the linear portion. Product in an inner passage of the product tube is thereby moved or dispensed. Another embodiment may include depressors attached to belts, wherein successive depressors may be driven along the linear portion to dispense or move the product. A method for using a linear peristaltic pump and the use of a controller to dispense product is also provided.

U.S. Patent Application 2008/0319394 to Yodfat et al. discloses an infusion system, method and device for infusing therapeutic fluid into the body of a patient. The device includes a driving mechanism including a plurality of gears, wherein at least one gear is adjacent to another gear. The device includes a gear in the plurality of gears having plurality of teeth and at least another gear in the plurality of gears having a plurality of teeth. The plurality of teeth of another gear interact with the plurality of teeth of the gear. At least one tooth in the plurality of teeth of the gear is elastically deformable for causing at least one tooth to elastically deform upon meshing with a tooth in the plurality of teeth of another gear and further for causing reduction of noise associated with operation of the driving mechanism.

U.S. Patent Application 2009/0074597 to Baecke discloses a roller pump which comprises an abutment, at least one roller and a casing. A pump hose is squeezed between the roller and the abutment. A hinge connects the abutment and the casing pivotably, the axis of the hinge being parallel to the plane of the pump hose. The invention further relates to a roller pump which comprises a resilient roll member which is fixed to the abutment. The pump hose is pressed against the resilient roll member. The invention additionally relates to a roller pump which comprises two roller gears. Each roller gear being torque-proof connected to one of the two rollers. The two roller gears engage with another gear for ensuring zero relative velocity of the portion of the rollers squeezing the pump hose with respect to the squeezed portions of the pump hose. The invention finally relates to a roller pump which comprises a drive train for mechanically connecting a motor and the rollers. The drive train comprises a sliding hub for limiting the transmitted torque.

Although the aforementioned prior art have contributed to the development of the art of peristaltic pump, none of these prior art patents have solved the needs of this art.

Therefore, it is an object of the present invention to provide an improved linear peristaltic pump.

Another object of this invention is to provide an improved linear peristaltic pump utilizing a rotary driving mechanism.

Another object of this invention is to provide an improved apparatus that is simple for the operator to use.

Another object of this invention is to provide an improved apparatus that is easy to cost effectively produce.

The foregoing has outlined some of the more pertinent objects of the present invention. These objects should be construed as being merely illustrative of some of the more prominent features and applications of the invention. Many other beneficial results can be obtained by applying the disclosed invention in a different manner or modifying the invention with in the scope of the invention. Accordingly other objects in a full understanding of the invention may be had by referring to the summary of the invention and the detailed description describing the preferred embodiment of the invention.

SUMMARY OF THE INVENTION

A specific embodiment of the present invention is shown in the attached drawings. For the purpose of summarizing the invention, the invention relates to an improved linear peristaltic pump for pumping a fluid through a flexible tube. The improved linear peristaltic pump comprises a central member mounted for rotation about a central shaft. A plurality of planetary gear are mounted by a plurality of planetary gear shafts to the central member, respectively. A ring gear is disposed in a mesh engagement with each of the plurality of planetary gears. A roller is disposed on each of the planetary gears offset from the planetary gear shafts, respectively. A generally flat compression surface is located relative to the central axis for enabling the flexible tube to be inserted between the generally flat compression surface and at least one of the plurality of rollers. A motor effects relative rotation between the central member and the ring gear for enabling the plurality of rollers to serially collapse the flexible tube and to move in a substantially linear motion along the generally flat compression surface for pumping the fluid through the flexible tube.

In one example, the ring gear is an outer ring gear disposed outside of the plurality of planetary gears. In another example, the ring gear is an inner ring gear disposed inside of the plurality of planetary gears.

In a more specific embodiment of the invention, the plurality of planetary gears are radially mounted about a periphery of the central member. Each of the rollers is an idler roller. The motor rotates the central member relative to the ring gear and the ring gear is fixed relative to the motor. In one example, a motor drive connects the motor to the central shaft for rotating the central shaft and the central member mounted to the central shaft for rotation in accordance with the central shaft.

In one embodiment of the invention, the improved linear peristaltic pump includes a pivot for pivotably mounting the generally flat compression surface between an open position and a closed position. The open position enables insertion and removal of flexible tube between the generally flat compression surface and at least one of the plurality of rollers. The closed position causes engagement between the generally flat compression surface and at least one of the plurality of rollers.

In still another embodiment of the invention, the improved linear peristaltic pump includes a resilient member for accommodating minute non-linear motion of the plurality of rollers along the generally flat compression surface. In one example, the resilient member comprises a resilient spring for biasing the generally flat compression surface toward the central shaft. In another example, the resilient member comprises the flexible tube having a tube wall of sufficient thickness and sufficient resiliency for accommodating minute non-linear motion of the plurality of rollers along the generally flat compression surface.

The foregoing has outlined rather broadly the more pertinent and important features of the present invention in order that the detailed description that follows may be better understood so that the present contribution to the art can be more fully appreciated. Additional features of the invention will be described hereinafter which form the subject matter of the invention. It should be appreciated by those skilled in the art that the conception and the specific embodiments disclosed may be readily utilized as a basis for modifying or designing other structures for carrying out the same purposes of the present invention. It should also be realized by those skilled in the art that such equivalent constructions do not depart from the spirit and scope of the invention.

BRIEF DESCRIPTION OF THE DRAWINGS

For a fuller understanding of the nature and objects of the invention, reference should be made to the following detailed description taken in connection with the accompanying drawings in which.

Similar reference characters refer to similar parts throughout the several Figures of the drawings.

DETAILED DISCUSSION

Figure 1:
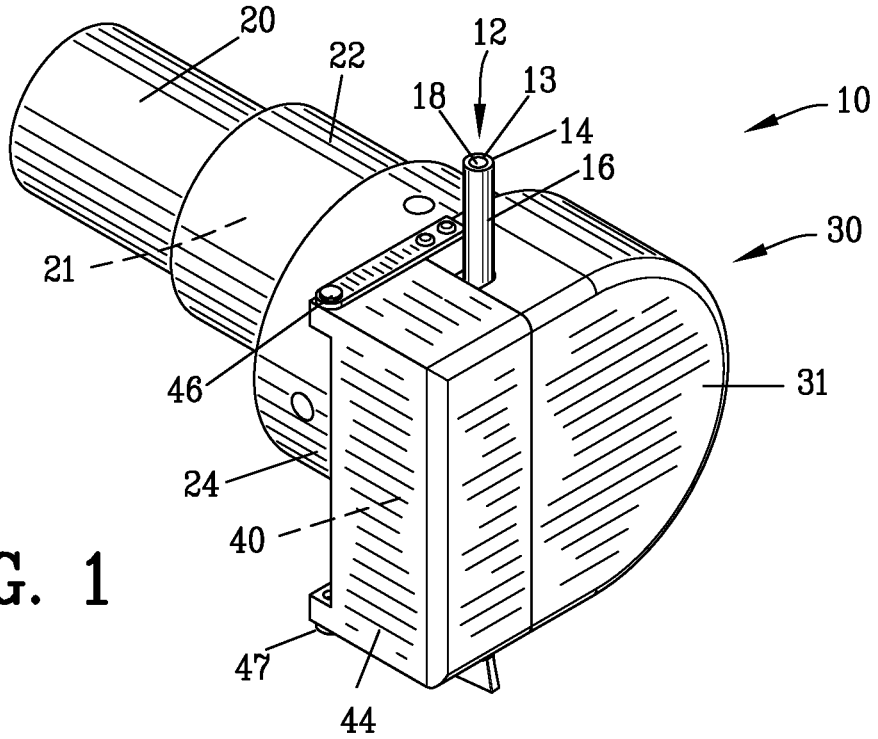
FIG. 1 is a right isometric view of the linear peristaltic pump of the present invention.
Figure 2:
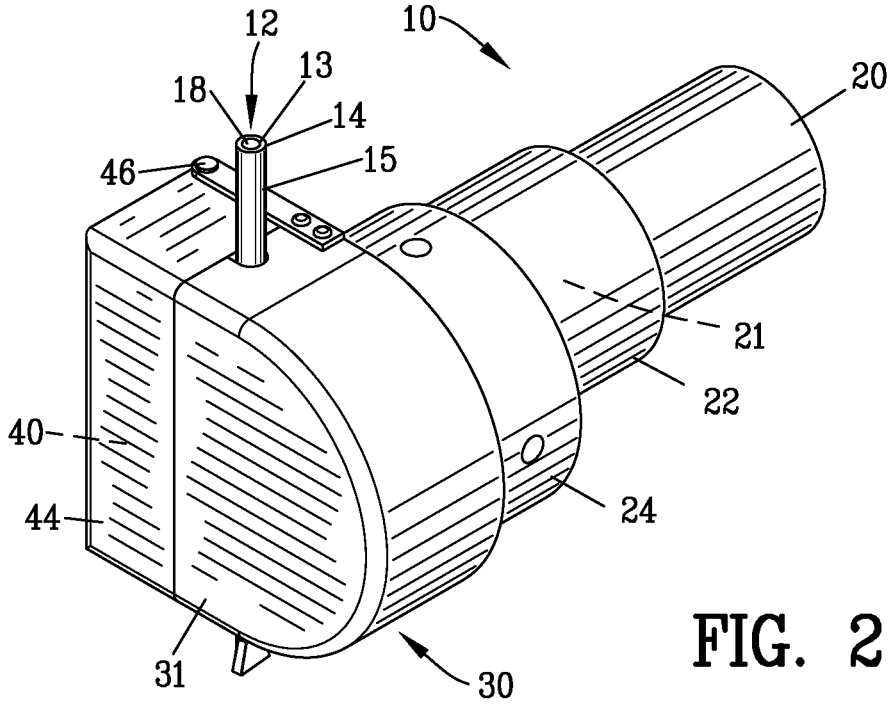
FIG. 2 is a left isometric view of the linear peristaltic pump of the present invention.
Figure 3:
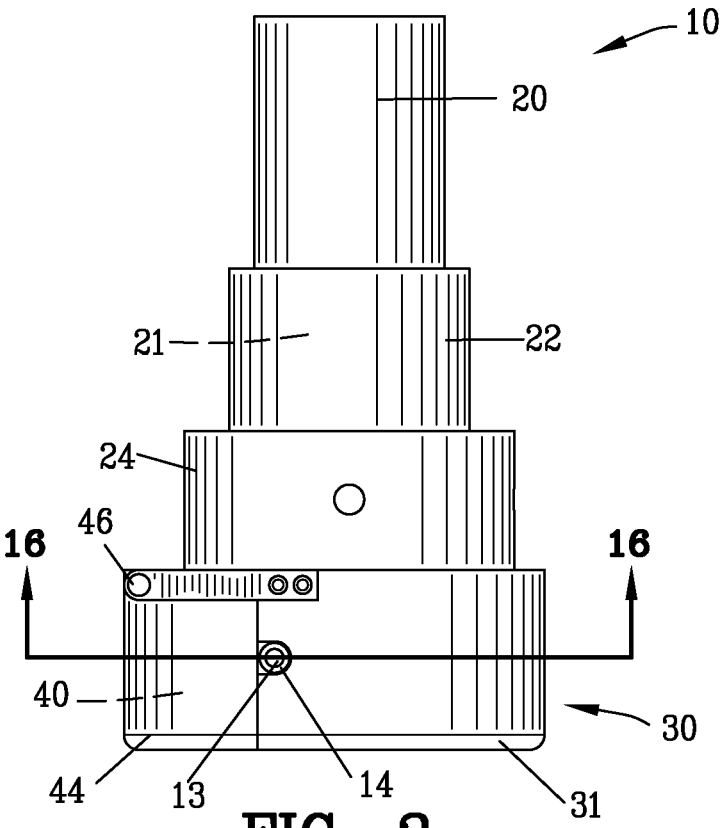
FIG. 3 is a top view of the linear peristaltic pump.
Figure 4:
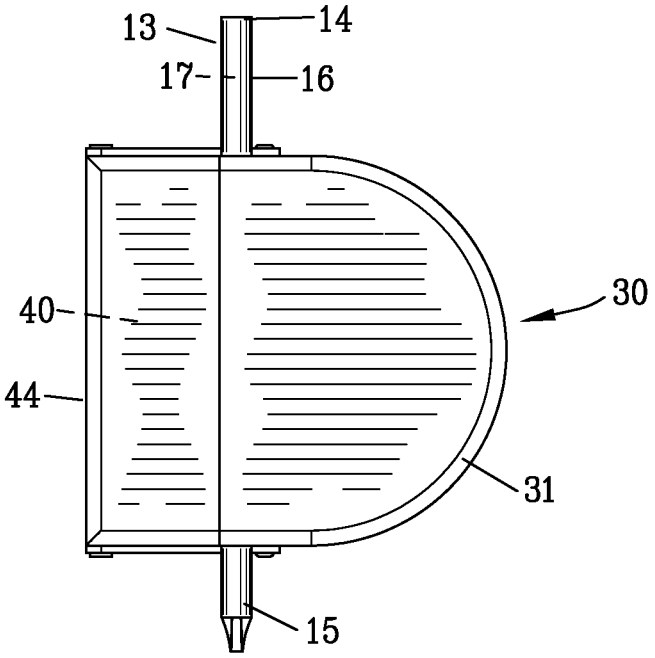
FIG. 4 is a front view of FIG. 3.

FIGS. 1-5 are various views of the linear peristaltic pump 10 of the present invention for pumping a fluid 12 through a flexible tube 13. The flexible tube 13 extends between a first end 14 and a second end 15. The flexible tube 13 has a flexible tube wall 16 defining a lumen 17. Typically, the first end 14 of the flexible tube 13 is connected to a source of the fluid 12 for enabling the linear peristaltic pump 10 to discharge the fluid 12 from a second end 15 of the flexible tube 13. Preferably, the flexible tube 13 is formed of a flexible polymeric material such as silicone or thermo plastics elastomor (TPE) or any other suitable flexible material.

The linear peristaltic pump 10 comprises a motor 20 having a motor shaft 21 connected to a motor drive 22. A motor mounting 24 is connected to the motor drive 22 for mounting the motor 20 in an external device (not shown) such as a support frame, an external machine and the like. The motor drive 22 couples the motor 20 to a pump mechanism 30.

Various types of motors 20 may be used with the present invention including direct current (DC) motors, stepping motors and the like. In the event a direct current (DC) motor is used, the motor drive 22 may include a reduction gear box. In the event a stepping motor is used, the motor drive 22 may include a direct drive between the stepping motor and the pump mechanism 30. A pump closure 31 covers the pump mechanism 30 as shown in FIGS. 1-5.

Figure 5:
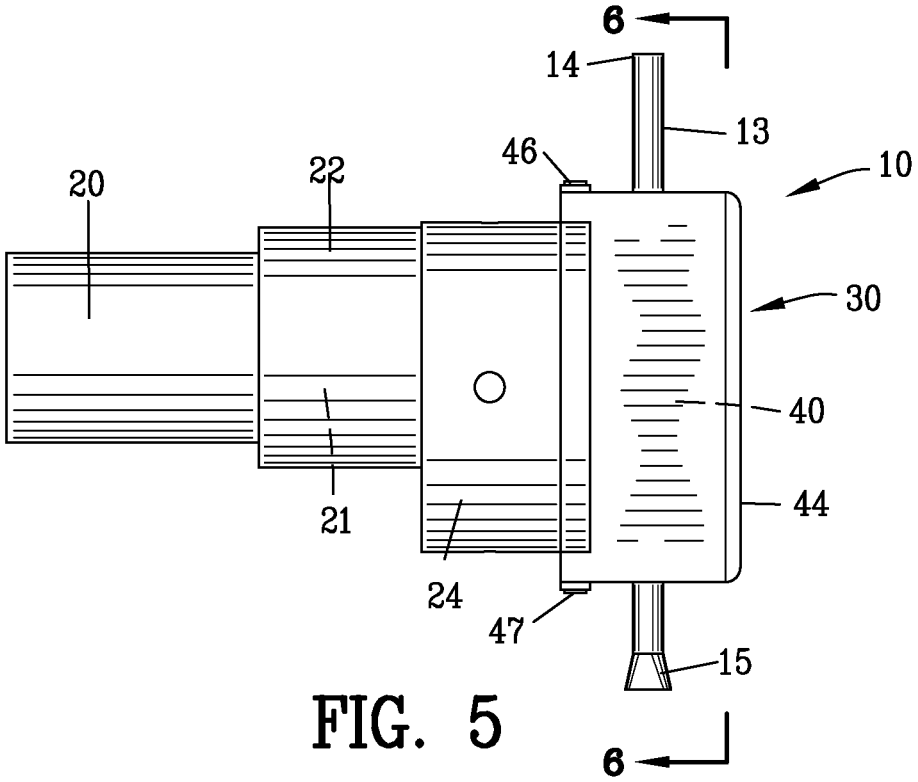
FIG. 5 is a left side view of FIG. 4.
Figure 6:
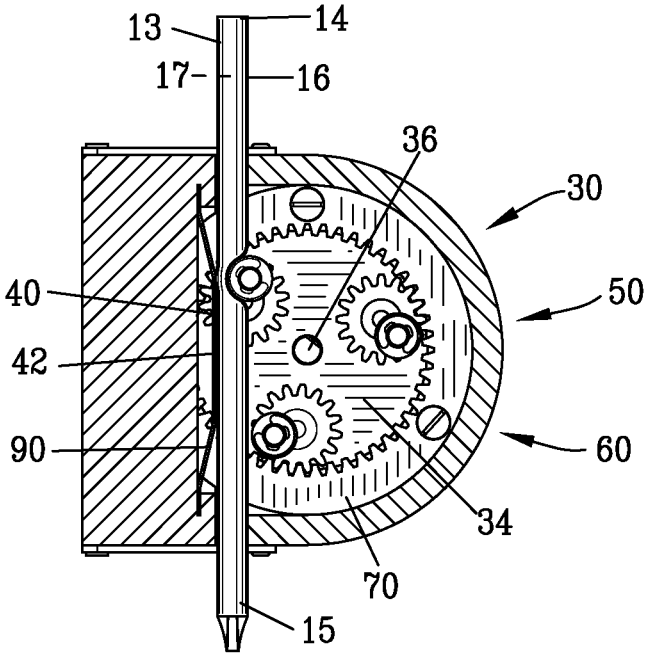
FIG. 6 is a sectional view along line 6-6 in FIG. 5.
Figure 7:
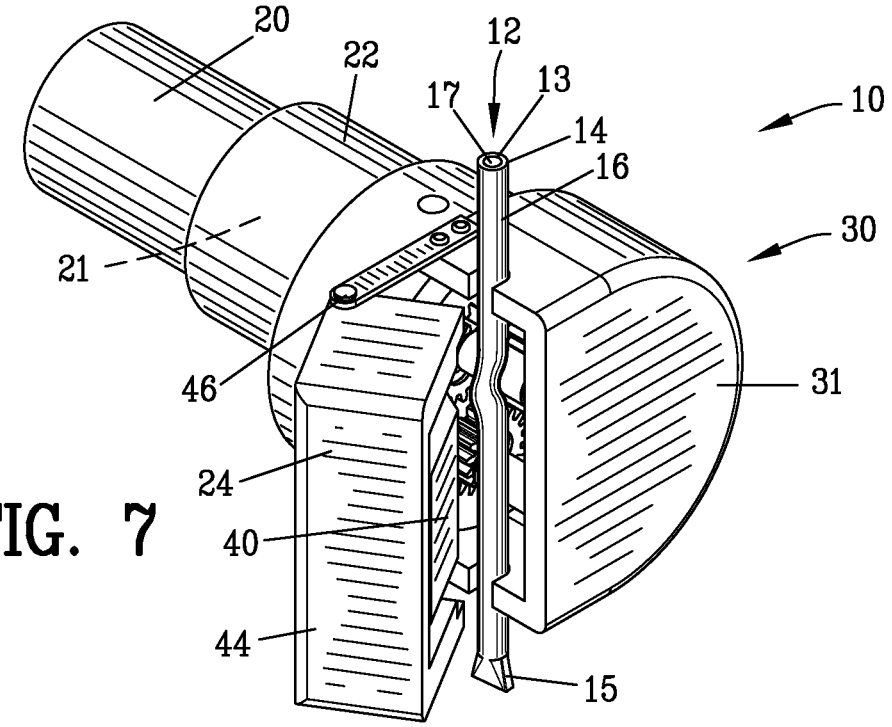
FIG. 7 is a right isometric view similar to FIG. 1 with the linear peristaltic pump in an open position.
Figure 8:
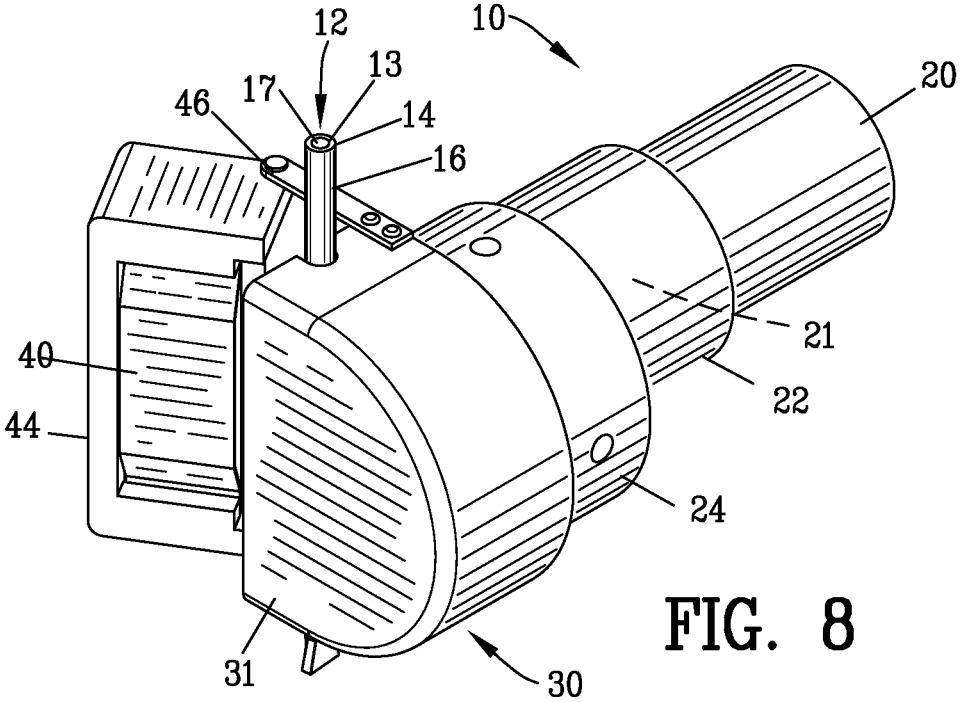
FIG. 8 is a left isometric view similar to FIG. 2 with the linear peristaltic pump in the open position.
Figure 9:
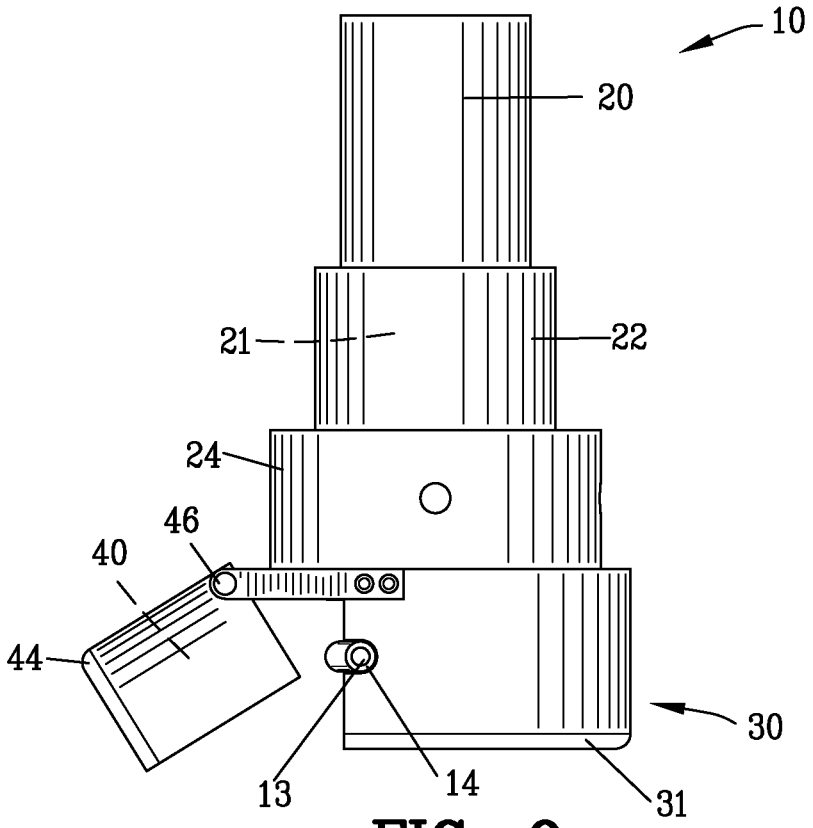
FIG. 9 is a top view of the linear peristaltic pump in the open position.
Figure 10:
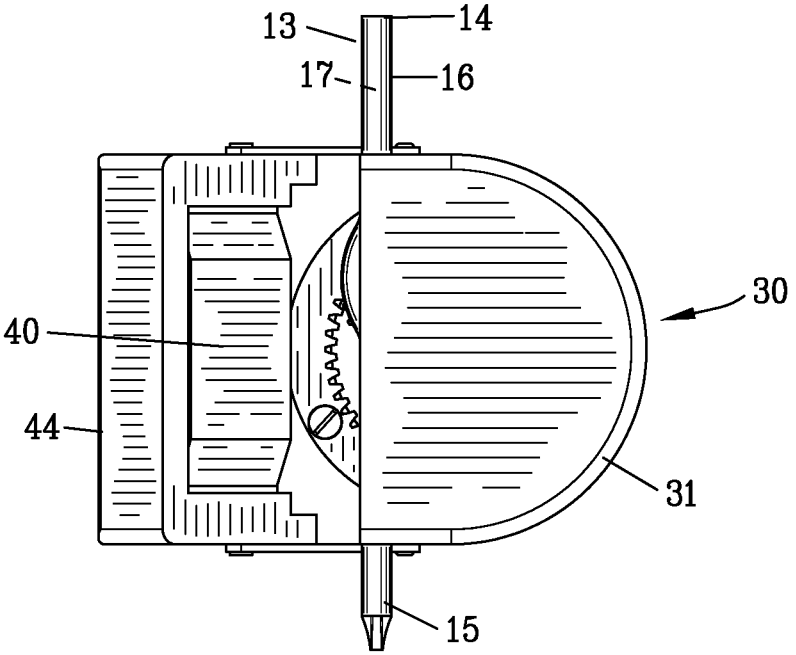
FIG. 10 is a front view of FIG. 9 with the linear peristaltic pump in the open position.
Figure 11:
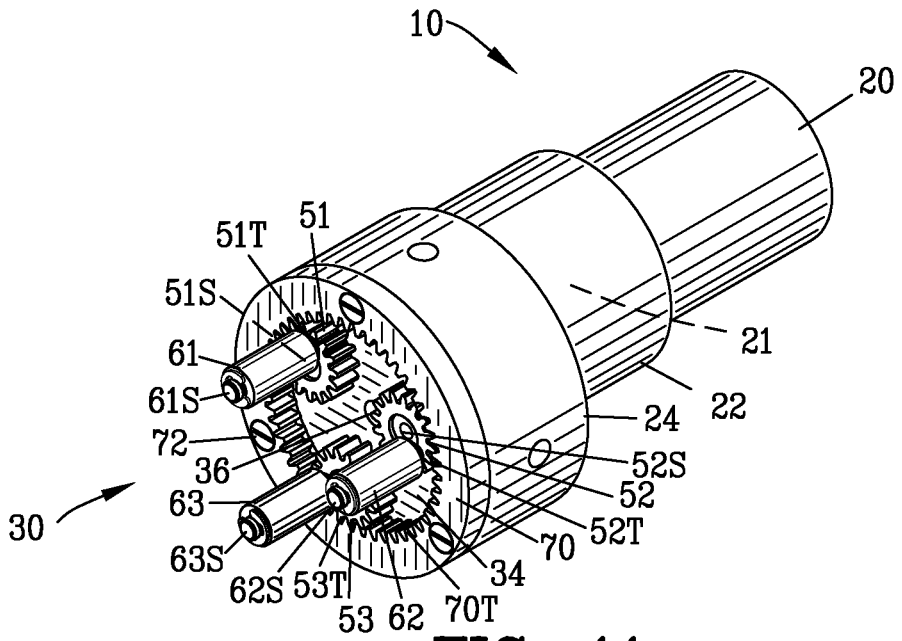
FIG. 11 is a left isometric view of the linear peristaltic pump after removal of a pump housing.
Figure 12:
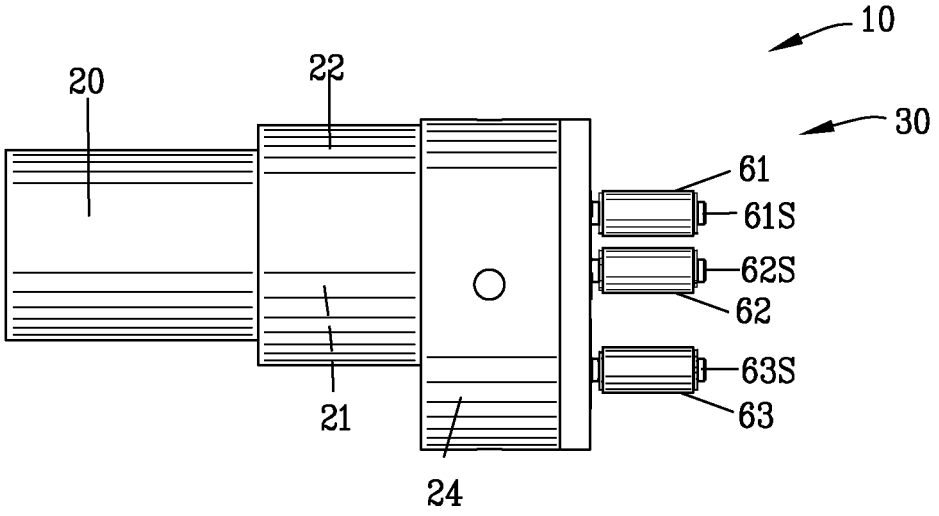
FIG. 12 is a left side view of FIG. 11.
Figure 13:
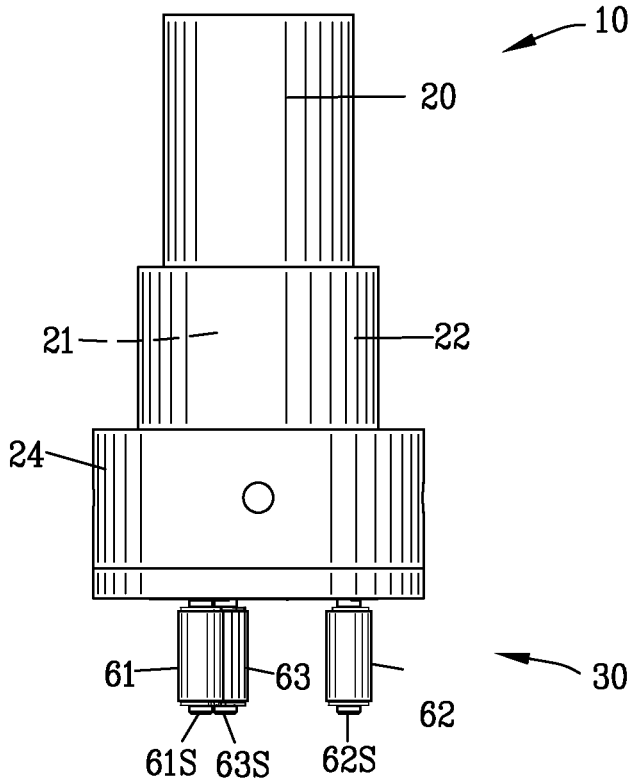
FIG. 13 is a top view of FIG. 11.
Figure 14:
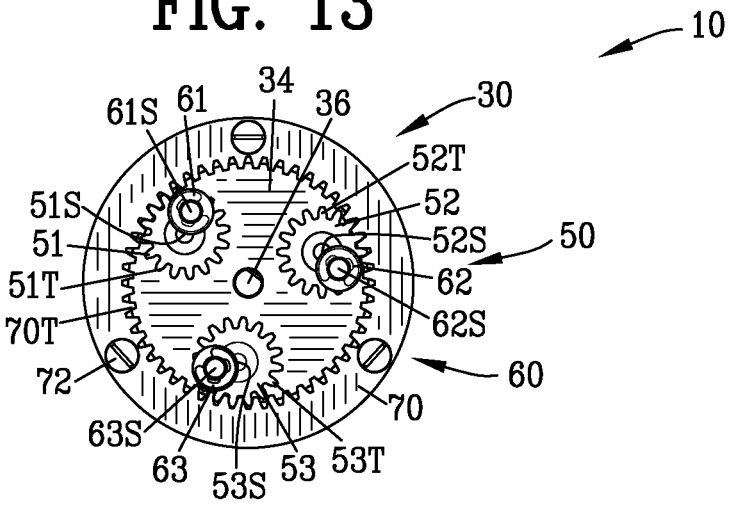
FIG. 14 is a front view of FIG. 13.

FIG. 6 is a sectional view along line 6-6 in FIG. 5 illustrating the pump mechanism 30. A compression surface 40 is enclosed by a compression surface cover 44 shown in FIGS. 1-5. The compression surface cover 44 is connected to the motor mounting 24 by pivots 46 and 47. The compression surface cover 44 is moveable on the pivots 46 and 47 between an open and a closed position. FIGS. 1-5 illustrate the compression surface cover 44 pivoted into a closed position.

FIGS. 7-10 illustrate the compression surface cover 44 pivoted into an open position. The open position of the compression surface cover 44 enables the flexible tube 13 to be inserted and removed from the pump mechanism 30 without restriction. The closed position of the compression surface cover 44 engages the flexible tube 13 between the pump mechanism 30 compression surface 40 as shown in FIG. 6.

FIGS. 11-14 are various views of the linear peristaltic pump 10 after removal of the pump closure 31 and the compression surface cover 44. The pump mechanism 30 comprises a central member 34 mounted for rotation about a central shaft 36. In this example, the central member 34 is fixed to the central shaft 36 with the central shaft 36 being connected through the motor drive 22 for rotation by the motor 20.

A planetary gears system 50 comprises a plurality of planetary gears 51-53 mounted by a plurality of planetary gear shafts 51S-53S to the central member, respectively. The plurality of planetary gears are mounted radially about a periphery of the central member 34. The plurality of planetary gear shafts 51S-53S defined gear teeth 51T-53T.

Rollers 61-63 are disposed on the planetary gears 51-53. Roller shaft 61S-63S are secured to planetary gears 51-53 with the roller shaft 61S-63S being offset from the planetary gear shafts 51S-53S. Roller shaft 61S-63S are affixed to the outer periphery of the planetary gears 51-53 to provide the offset of the roller shaft 61S-63S from the planetary gear shafts 51S-53S. The rollers 61-63 freely rotate on roller shafts 61S-63S as idler rollers.

A ring gear 70 in a mesh engagement with the plurality of planetary gears 51-53. In the embodiment, the ring gear 70 is shown as an outer ring gear 70 disposed about the plurality of planetary gears 51-53 and concentric with the central shaft 36. The outer ring gear 70 is secured to the motor drive 22 by an outer ring gear mounting 72. The outer ring gear 70 defines outer ring gear teeth 70T. Each of the gear teeth 51T-53T of the plurality of planetary gears 51-53 are in a mesh engagement with the outer ring gear teeth 70T of the outer ring gear 70.

Figure 15:
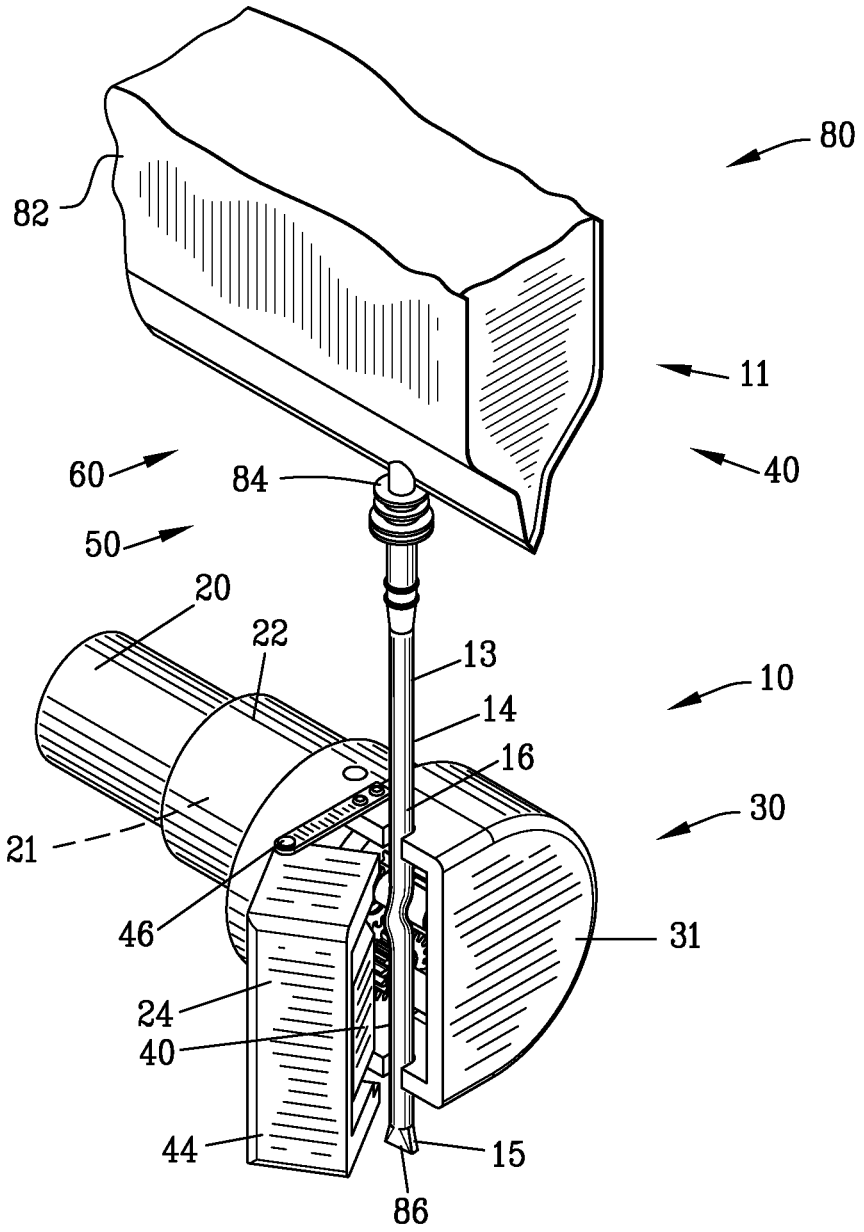
FIG. 15 is an isometric view of a dispensing system incorporating the linear peristaltic pump of the present invention.

FIG. 15 is an isometric view of an example of dispensing system 80 incorporating the linear peristaltic pump 10 of the present invention. The dispensing system 80 includes a container 82 for containing the fluid 12. A coupling 84 secures the first end 14 of the flexible tube 13 to the container 82. A check valve 86 is affixed adjacent to the second end 15 of the flexible tube 13. In this embodiment, the check valve 86 is integrally molded into the flexible tube 13, but it should be understood that a separate and distinct check valve 86 may be affixed to the flexible tube 13. In this example, the check valve 86 is shown as a duck bill check valve, although various other types of check valves may be used in the dispensing system 80. The check valve 86 retains the fluid 12 within the container 82 and the flexible tube 13 under normal atmospheric conditions.

The compression surface cover 44 is shown pivoted on hinges 46 and 47 into the open position. The container 82 and the flexible tube 13 are positioned for introducing the flexible tube 13 between the compression surface 40 and the rollers 61-63 of the pump mechanism 30. It should be understood by those skilled in the art, that the dispensing system 80 shown in FIG. 15 is only a single example of possible uses of the present invention and that many other uses and dispensing systems 80 may be used with the linear peristaltic pump 10 of the present invention.

Figure 16:
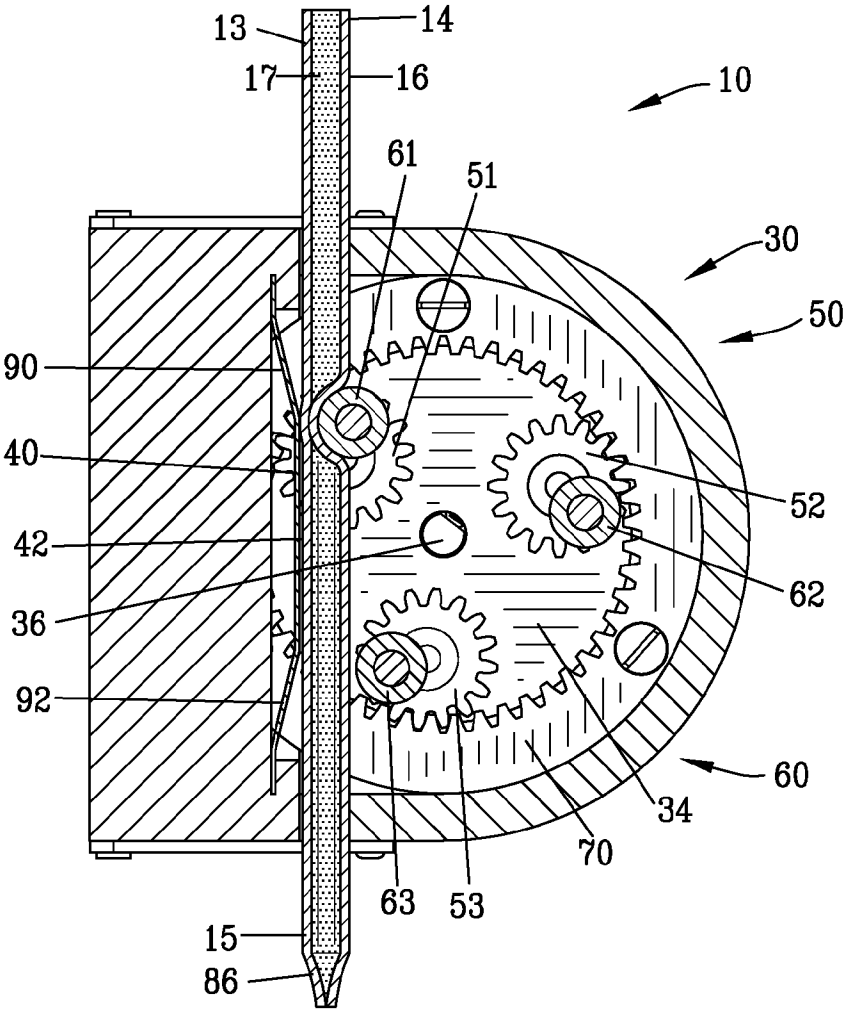
FIG. 16 is an enlarged sectional view along line 16-16 in FIG. 3 with the linear peristaltic pump in a first rotational position.

FIG. 16 is an enlarged front view of a first embodiment of the linear peristaltic pump 10 with the pump closure 31 and the compression surface cover 44 removed for illustrative purposes. The linear peristaltic pump 10 is shown in a first rotational position. The compression surface cover 44 (not shown in FIG. 16) is pivoted on hinges 46 and 47 into the closed position whereat the flexible tube 13 engages one of the rollers 61-63 and the compression surface 40.

In contrast to many of the peristaltic pumps of the prior art, the compression surface 40 has a generally flat or planar surface 42 while being used with the rotary pump mechanism 30. The combination of the plurality of planetary gears 51-53 in combination with the offset rollers 61-63 provide a substantially linear of the rollers 61-63 along the generally flat or planar compression surface 40. A resilient mechanism 90 is incorporated into the linear peristaltic pump 10 to compensate for minute non-linear motion of the plurality of rollers 61-63 along the flat or planar compression surface.

In this embodiment, the resilient mechanism 90 is shown as a spring 92 mounted between the compression surface cover 44 and the compression surface 40. The spring 92 biases the compression surface 40 toward the central shaft 36, Although, the spring 92 has been shown as a particular type of leaf spring, it should be understood that any other type resilient device may be use as will become evident with reference to FIGS. 23 and 24.

FIG. 16 illustrates the first embodiment of the linear peristaltic pump 10 in a first rotational position. The fluid 12 is contained within the tube 13 and the container 82 by the check valve 86. In the first rotational position, the roller 61 compresses the flexible tube 13 to separate the fluid 12 in the flexible tube 13 between a region adjacent to the first end 14 of the flexible tube 13 and a region adjacent to the second end 15 of the flexible tube 13. Preferably, the roller 61 completely collapses the flexible tube 13 as shown in FIG. 16.

In this example, the outer ring gear 70 is fixed relative to the motor mounting 24. The motor 20 rotates the central member 34 about the central shaft 36 in a counterclockwise direction. The central member 34 moves the plurality of planetary gears shafts 51S-53S in a counterclockwise direction. Each of the plurality of planetary gears 51-53 is in mesh engagement with the fixed outer ring gear 70. The counterclockwise rotation of the central member 34 results in a clockwise rotation of each of the plurality of planetary gears 51-53.

Figure 17:
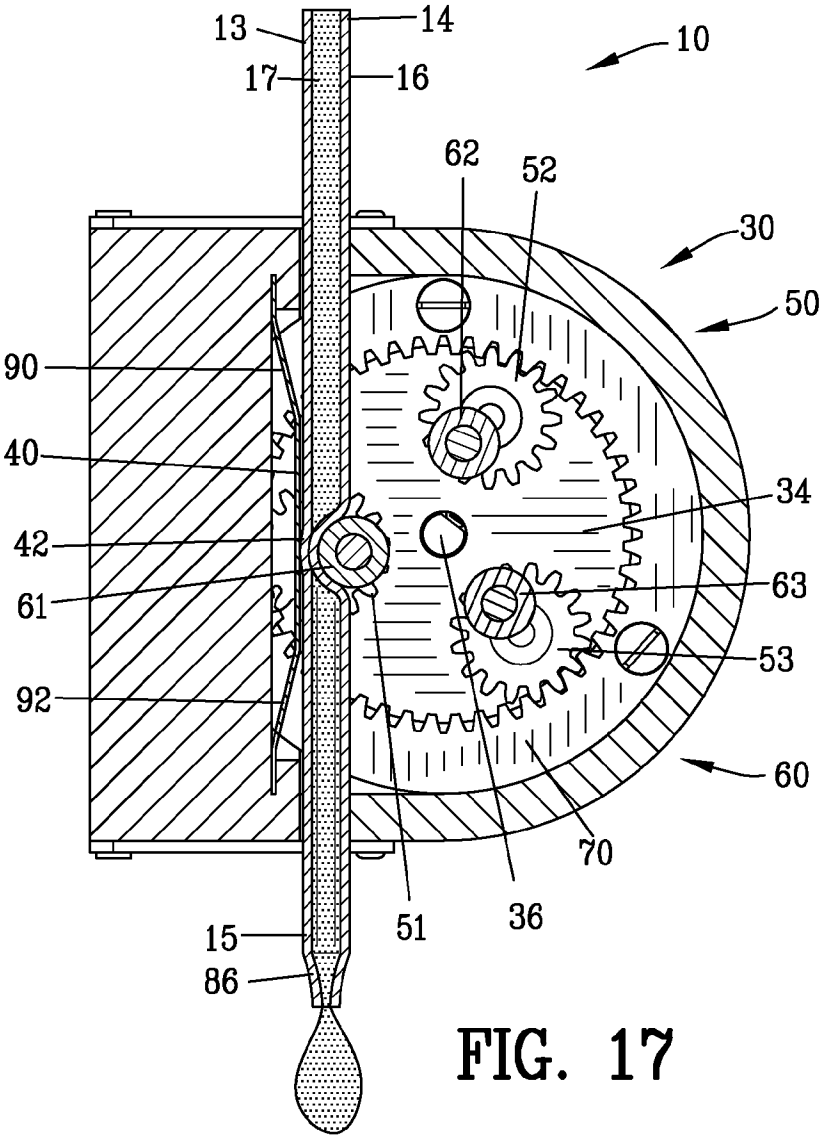
FIG. 17 is a view similar to FIG. 16 with the linear peristaltic pump in a second rotational position.

FIG. 17 is a view similar to FIG. 16 with the linear peristaltic pump 10 in a second rotational position. The counterclockwise rotation of the central member 34 with the clockwise rotation of the planetary gear 51 in combination with the offset roller 61 results in a substantially linear movement of the roller 61 along the flat compression surface 40.

Figure 18:
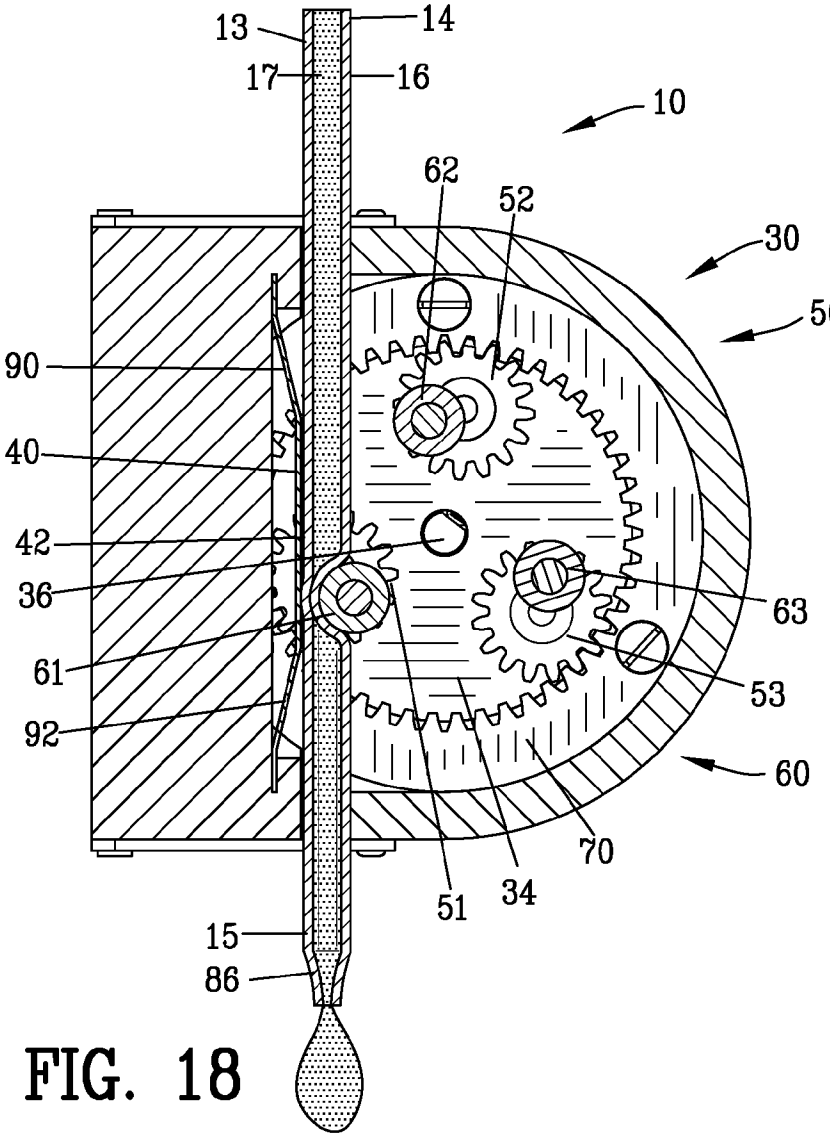
FIG. 18 is a view similar to FIG. 16 with the linear peristaltic pump in a third rotational position.

FIG. 18 is a view similar to FIG. 16 with the linear peristaltic pump 10 in a third rotational position. The counterclockwise rotation of the central member 34, the clockwise rotation of the planetary gear 51 moves the offset roller 61 in a substantially linear movement along the flat compression surface 40.

Figure 19:
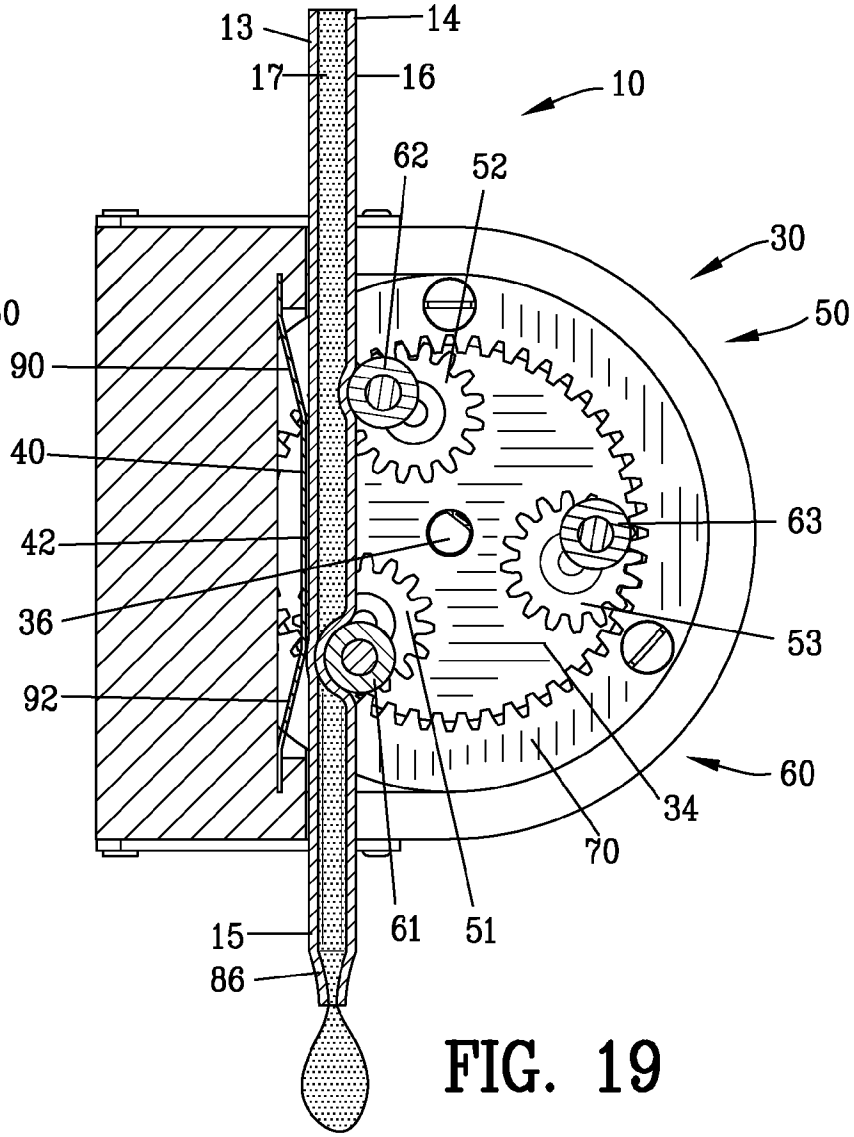
FIG. 19 is a view similar to FIG. 16 with the linear peristaltic pump in a fourth rotational position.

FIG. 19 is a view similar to FIG. 16 with the linear peristaltic pump 10 in a fourth rotational position. The offset roller 61 moves in a substantially linear motion along the flat compression surface 40. In this example, the resilient member 90 shown as the spring 92 resiliently mounts the flat compression surface 40 for accommodating for minute non-linear motion of the roller 61 along the flat compression surface 40. The resilient spring 92 biases the flat compression surface 40 toward the central shaft 36.

Figure 20:
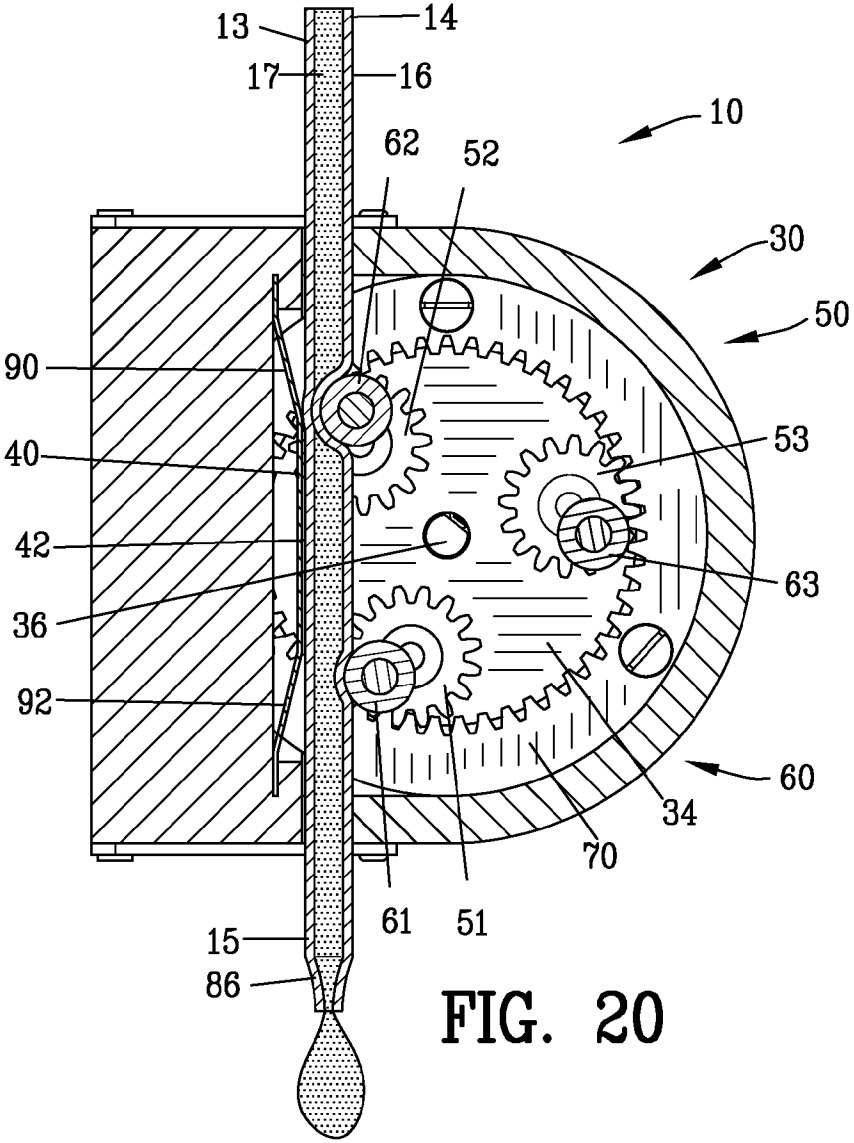
FIG. 20 is a view similar to FIG. 16 with the linear peristaltic pump in a fifth rotational position.

FIG. 20 is a view similar to FIG. 16 with the linear peristaltic pump 10 in a fifth rotational position. In the fifth rotational position, the roller 62 compresses the flexible tube 13 to separate the fluid 12 in the flexible tube 13 between a region adjacent to the first end 14 of the flexible tube 13 and a region adjacent to the second end 15 of the flexible tube 13. Preferably, the roller 62 completely collapses the flexible tube 13. The first roller 61 has been moved out of engagement with the flexible tube 13.

Figure 21:
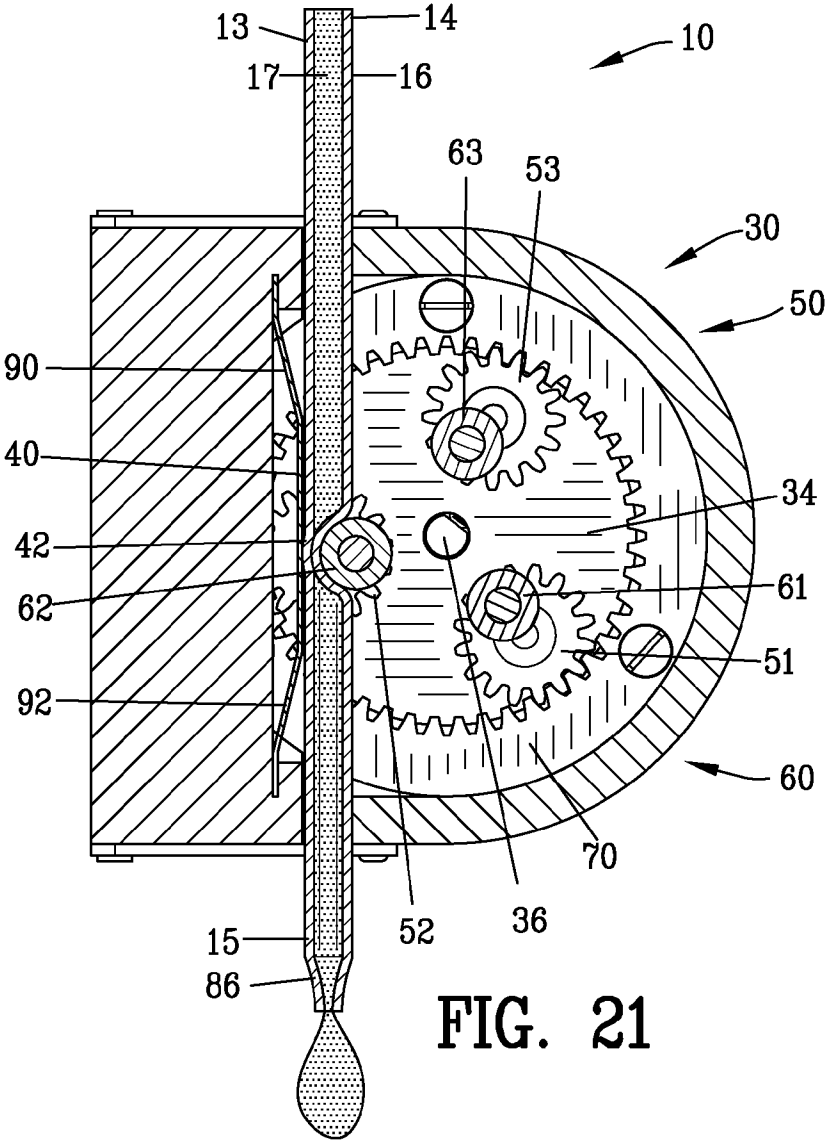
FIG. 21 is a view of the linear peristaltic pump returned to the first rotational position shown in FIG. 16.

FIG. 21 is a view similar to FIG. 16 with the linear peristaltic pump 10 in a sixth rotational position. The counterclockwise rotation of the central member 34 with the clockwise rotation of the planetary gear 52 in combination with the offset roller 62 results in a substantially linear movement of the roller 62 along the flat compression surface 40. It should be appreciated by those skilled in the art that the motor 20 may rotate the outer ring gear 70 for moving the plurality of rollers 61-63 to serially collapse the flexible tube 13 and to move in a substantially linear motion along the generally flat compression surface 40 for pumping the fluid 12 through the flexible tube 13.

Figure 22:
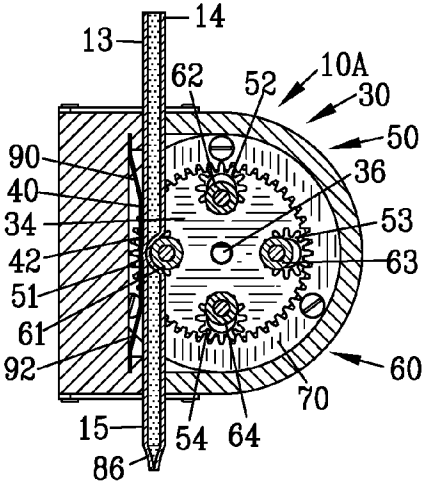
FIG. 22 is a sectional view of a second embodiment of the linear peristaltic pump of the present invention in a first rotational position.

FIG. 22 is a sectional view of a second embodiment of the linear peristaltic pump 10A of the present invention in a first rotational position. In this embodiment, the linear peristaltic pump 10A comprises four planetary gears 51-54 carrying four offset rollers 61-64. The roller 61 is shown completely collapses the flexible tube 13.

Figure 22A:
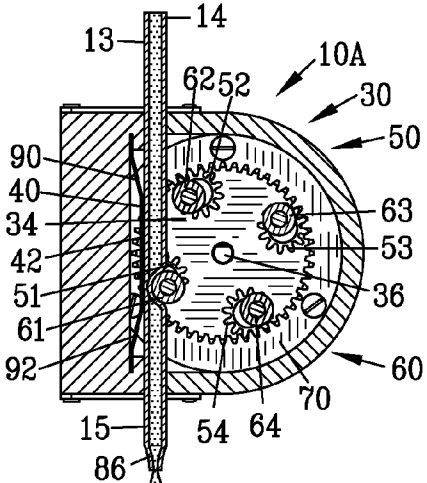
FIG. 22A is a view similar to FIG. 22 with the linear peristaltic pump in a second rotational position.

FIG. 22A is a view similar to FIG. 22 with the linear peristaltic pump 10A in a second rotational position. The counterclockwise rotation of the central member 34 with the clockwise rotation of the planetary gear 51 in combination with the offset roller 61 results in a substantially linear movement of the roller 61 along the flat compression surface 40.

Figure 22B:
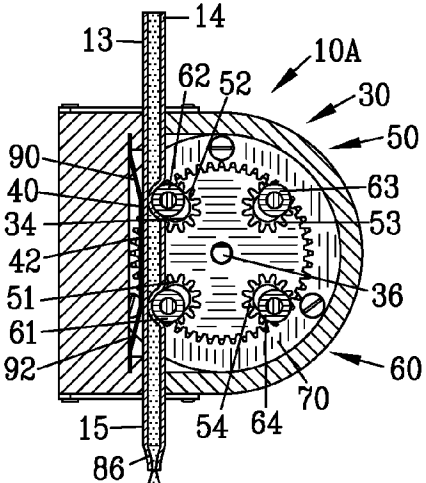
FIG. 22B is a view similar to FIG. 22 with the linear peristaltic pump in a third rotational position.

FIG. 22B is a view similar to FIG. 22 with the linear peristaltic pump 10A in a third rotational position. In the third rotational position, the roller 62 compresses the flexible tube 13 whiles the roller 61 continues to compress the flexible tube 13.

Figure 22C:
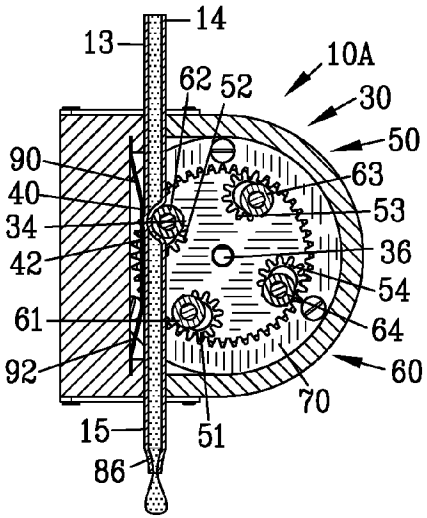
FIG. 22C is a view similar to FIG. 22 with the linear peristaltic pump in a fourth rotational position.

FIG. 22C is a view similar to FIG. 22 with the linear peristaltic pump 10A in a fourth rotational position. The roller 62 moves in a substantially linear movement along the flat compression surface 40. The first roller 61 has been moved out of engagement with the flexible tube 13.

Figure 22D:
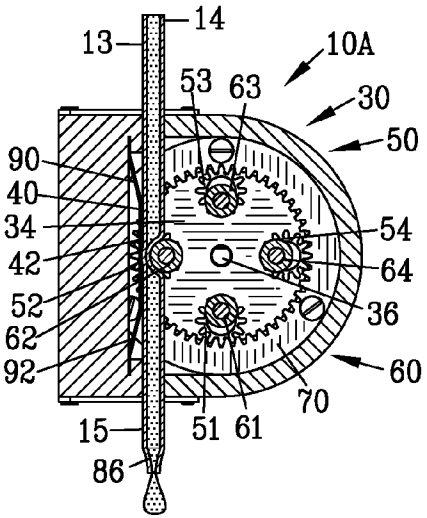
FIG. 22D is a view similar to FIG. 22 with the linear peristaltic pump in a fifth rotational position.

FIG. 22D is a view similar to FIG. 22 with the linear peristaltic pump 10A in a fifth rotational position. The roller 62 continues to move in a substantially linear movement along the flat compression surface 40.

Figure 22E:
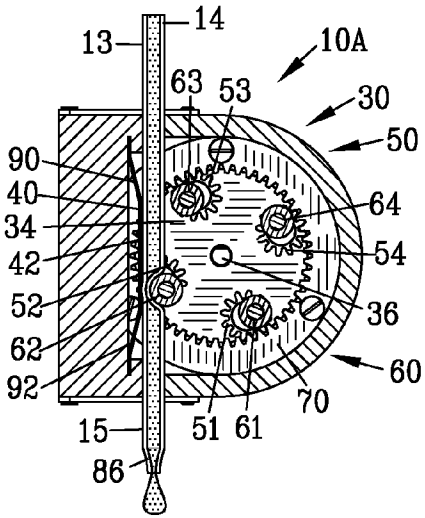
FIG. 22E is a view similar to FIG. 22 with the linear peristaltic pump in a sixth rotational position.

FIG. 22E is a view similar to FIG. 22 with the linear peristaltic pump 10A in a sixth rotational position. The roller 62 continues to move in a substantially linear movement along the flat compression surface 40. The roller 63 is positioned to compresses the flexible tube 13 upon further rotation of the central member 34.

Figure 23:
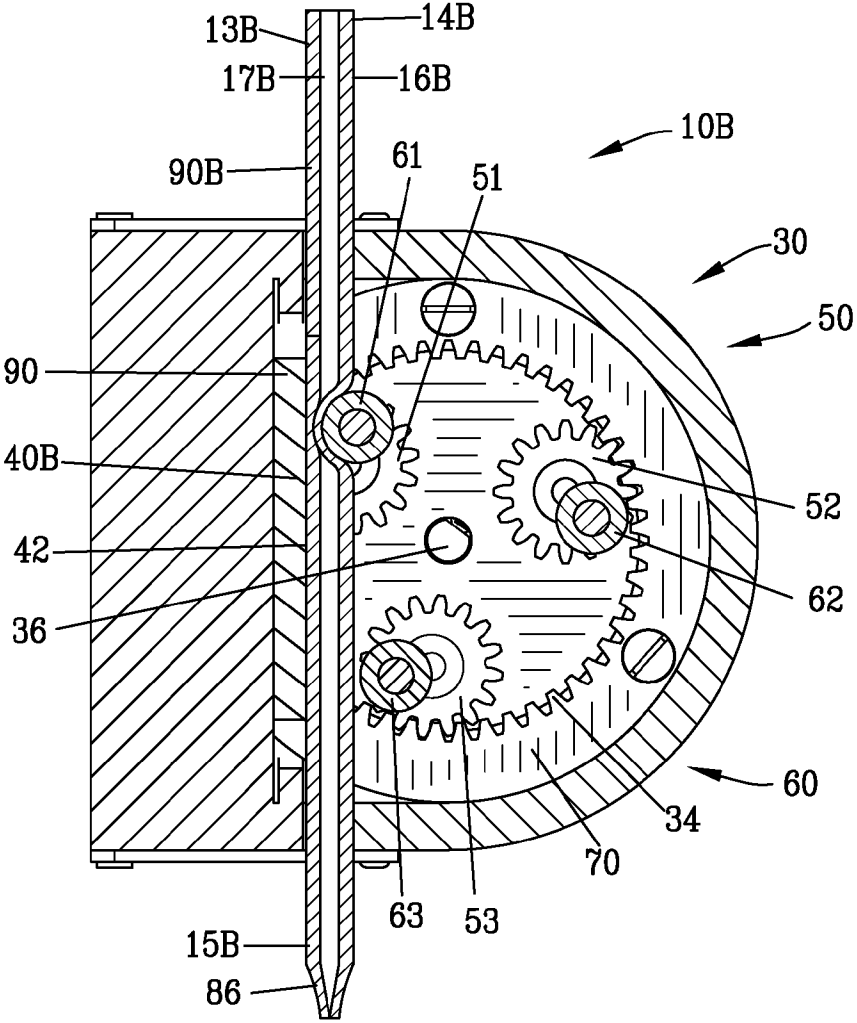
FIG. 23 is a sectional view similar to FIG. 16 illustrating an alternative resilient member.

FIG. 23 is a sectional view similar to FIG. 16 illustrating an alternative resilient member 90B. In this example, the compression surface 40B is substantially rigid. The resilient member 90B comprises a flexible tube 13B having a flexible tube wall 16B of sufficient thickness and sufficient resiliency accommodating for minute non-linear motion of the plurality of rollers 61-63 along the flat compression surface 40B.

Figure 24:
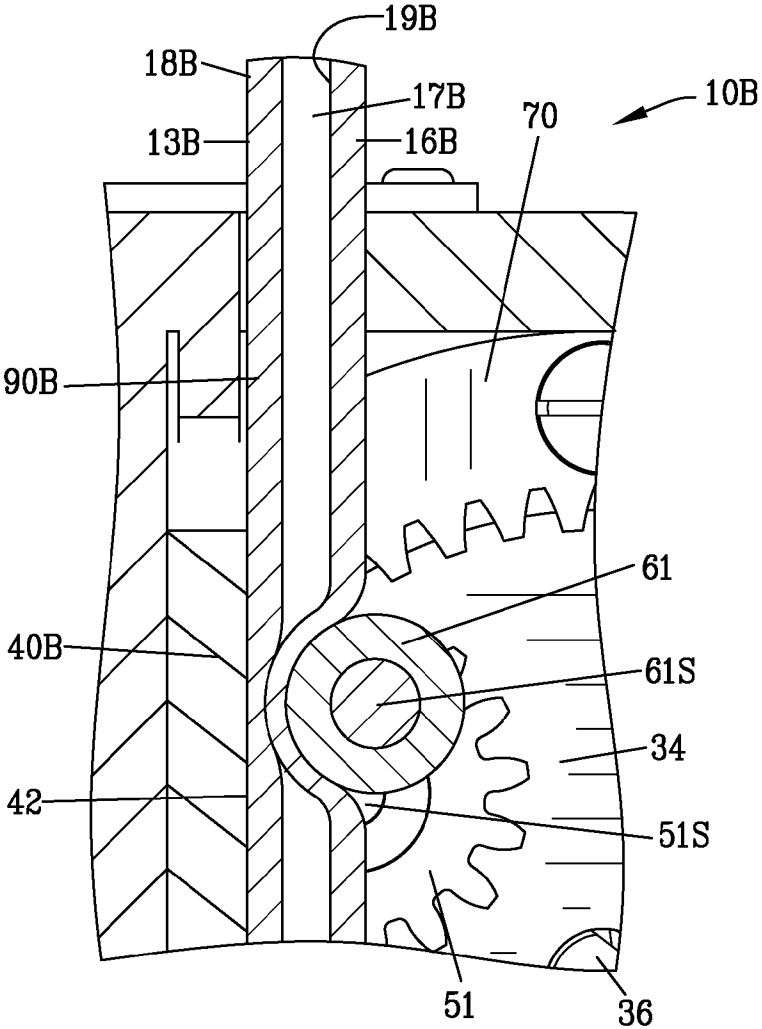
FIG. 24 is an enlarged view of a portion of FIG. 23.

FIG. 24 is an enlarged view of a portion of FIG. 23 illustrating the relationship of the outer diameter 18B of the flexible tube 13B and the inner diameter 19B of the lumen 17B.

Figure 25:
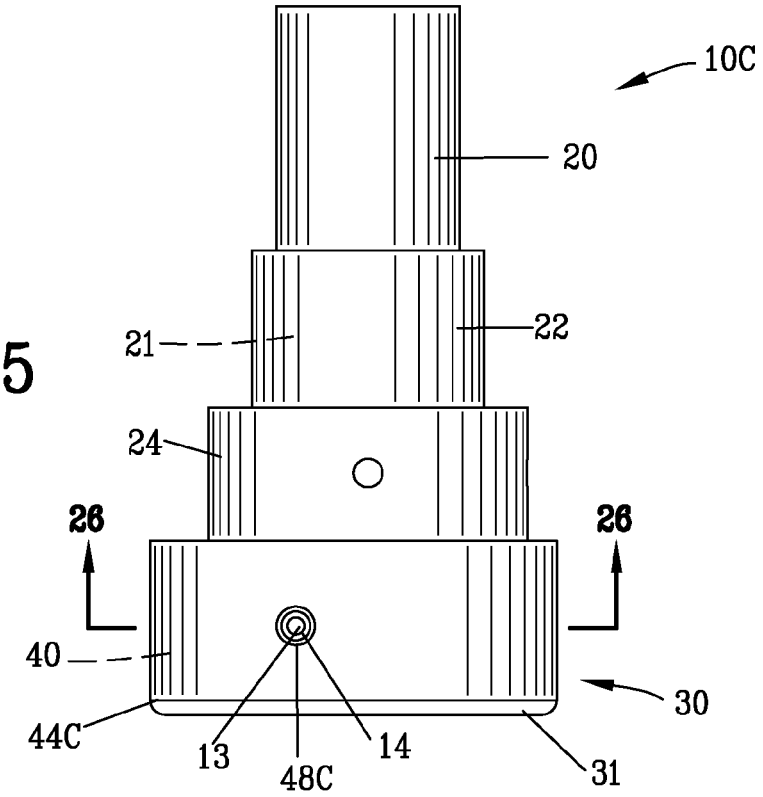
FIG. 25 a top view of a third embodiment of the linear peristaltic pump of the present invention.

FIG. 25 is a top view and sectional views of a third embodiment of the linear peristaltic pump 10C of the present invention. In this embodiment, the linear peristaltic pump 10C includes a fixed compression surface cover 44C having an aperture 48C for receiving the flexible tube 13.

Figure 26:
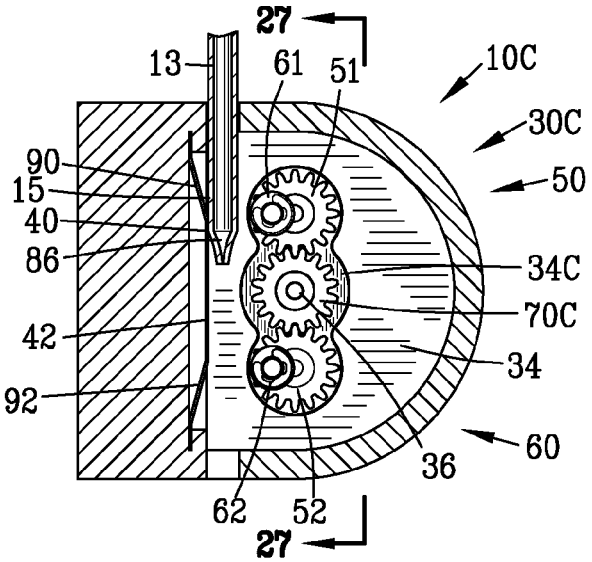
FIG. 26 is a sectional view along line 26-26 in FIG. 25 illustrating the inserting of a flexible tube.
Figure 27:
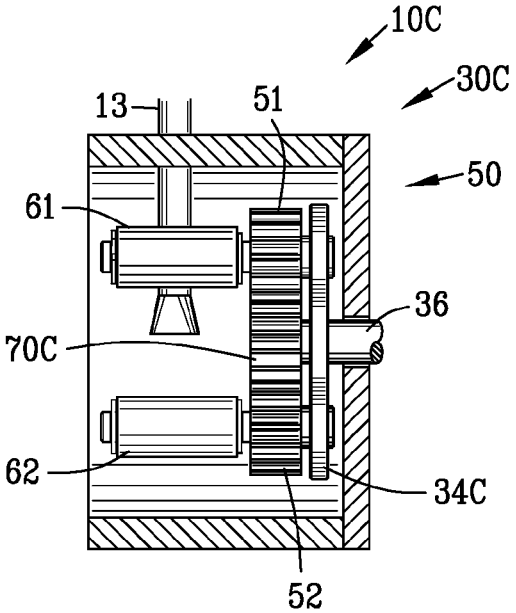
FIG. 27 is a view along line 27-27 in FIG. 26.

FIGS. 26 and 27 are sectional view of the third embodiment of the linear peristaltic pump 10C of FIG. 25 illustrating the inserting of the flexible tube 13. The pumping mechanism 30C comprises two planetary gears 51 and 52 carrying two offset rollers 61 and 62. The planetary gears 51 and 52 are rotatably mounted to a central member 34C. The central member of 34C is freely rotatable about the central shaft 36.

In this embodiment, the ring gear 70C is an inner ring gear 70C located between and in engagement with the two planetary gears 51 and 52. The inner ring gear 70C is secured to the central shaft 36. Rotation of the central shaft 36 results in movement of the planetary gears 51 and 52 as shown in FIGS. 28-31.

Figure 28:
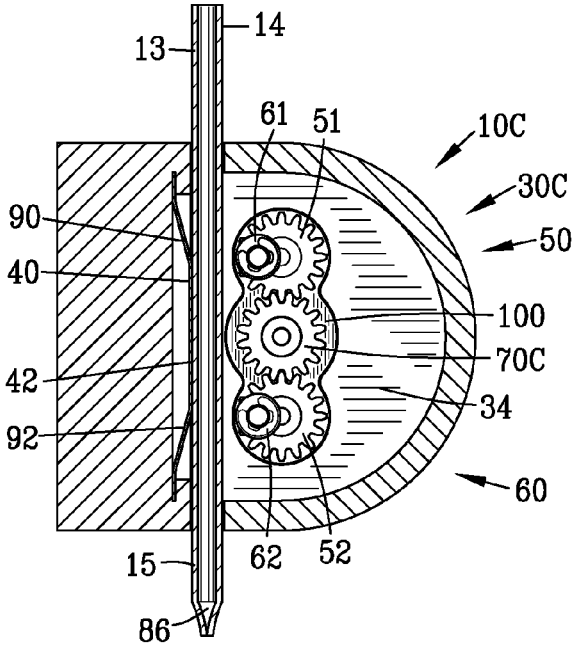
FIG. 28 is a view similar to FIG. 26 with the flexible tube fully inserted into the linear peristaltic pump.

FIG. 28 is a view similar to FIG. 26 with the flexible tube 13 fully inserted into the linear peristaltic pump 10C. Since the linear peristaltic pump 10C contains only to planetary gears 51 and 52, the flexible tube 13 may be inserted through the aperture 48C when the planetary gears 51 and 52 are disposed in the location shown in FIG. 28. The use of two planetary gears 51 and 52 eliminates the need for a pivotable compression surface cover 44.

Figure 29:
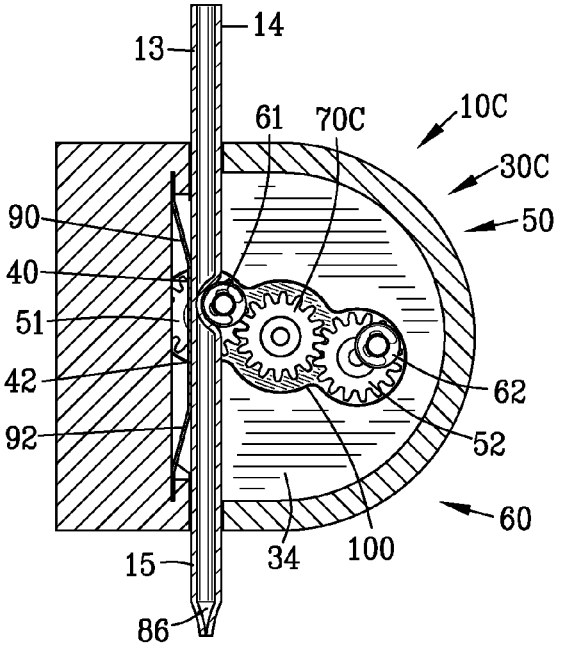
FIG. 29 is a view similar to FIG. 28 with the linear peristaltic pump in a second rotational position.

FIG. 29 is a view similar to FIG. 28 with the linear peristaltic pump in a second rotational position. The counterclockwise rotation of the central member 34C with the clockwise rotation of the planetary gear 51 in combination with the offset roller 61 results in a substantially linear movement of the roller 61 along the flat compression surface 40C.

Figure 30:
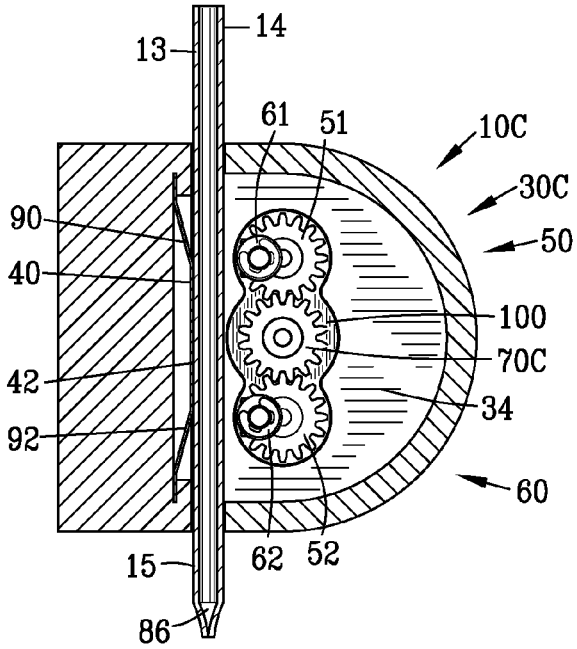
FIG. 30 is a view similar to FIG. 28 with the linear peristaltic pump in a third rotational position.

FIG. 30 is a view similar to FIG. 28 with the linear peristaltic pump in a third rotational position.

Figure 31:
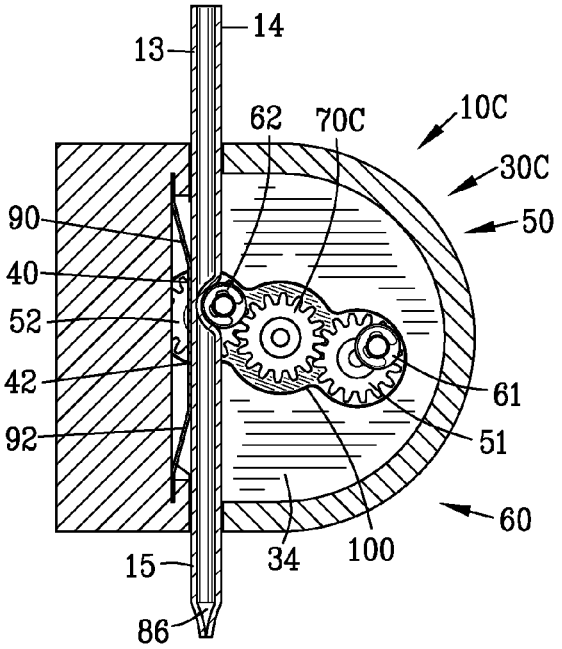
FIG. 31 is a view similar to FIG. 28 with the linear peristaltic pump in a forth rotational position.

FIG. 31 is a view similar to FIG. 28 with the linear peristaltic pump in a forth rotational position.

Figure 32:
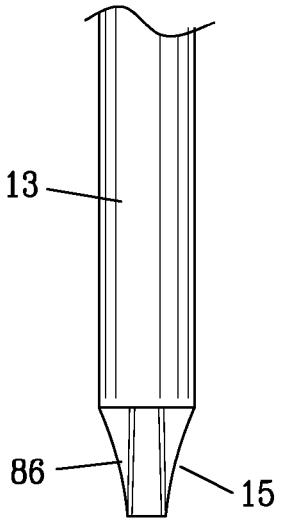
FIG. 32 is an enlarged view of a check valve in a closed position.
Figure 33:
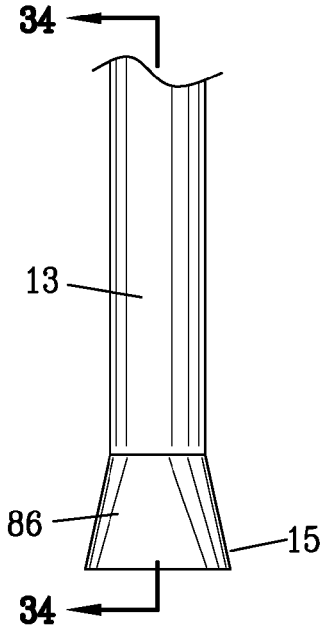
FIG. 33 is a side view of FIG. 32.
Figure 34:
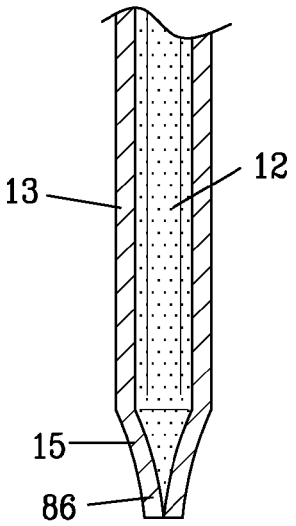
FIG. 34 is a sectional view along line 34-34 in FIG. 33.

FIG. 32-34 are enlarged views of an example of a check valve 86 suitable for use with the present invention in a closed position. The check valve 86 is shown as a duck bill check valve. Preferably, the duck bill check valve 86 is integrally formed with the flexible tube 13.

Figure 35:
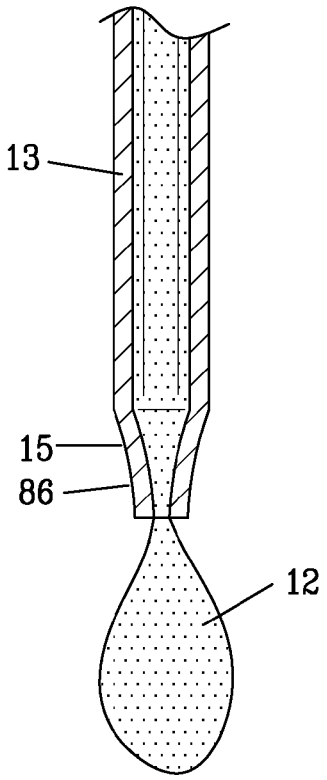
FIG. 35 is a view similar to FIG. 34 with the check valve in an open position.

FIG. 35 is a view similar to FIG. 34 with the check valve in an open position. The check valve 86 opens under the pressure of the linear peristaltic pump 10 to accurately control the volume of the fluid will dispense from the flexible tube 13.

Figure 36:
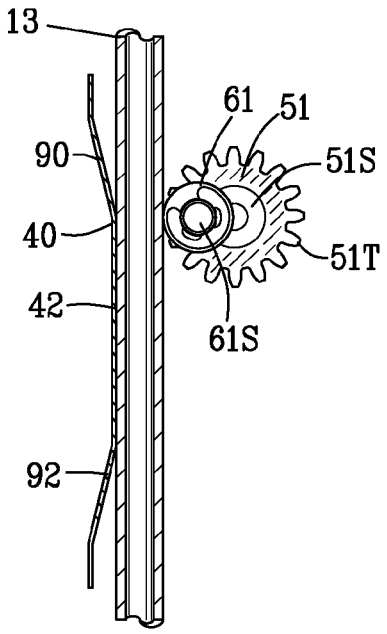
FIG. 36 is an enlarged view of the flexible tubing disposed between a compression surface and an idler roller.
Figure 37:
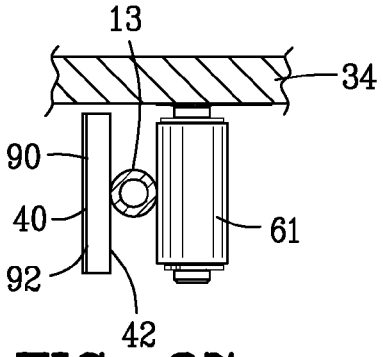
FIG. 37 is a top view of FIG. 36 illustrating the idler roller engaging the flexible tubing.

FIGS. 36 and 37 are enlarged views of the flexible tubing 13 disposed between the compression surface 40 and an idler roller 61. The resilient member 90 is in an uncompressed condition.

Figure 38:
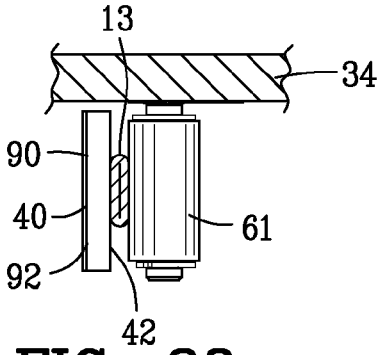
FIG. 38 is a top view similar to FIG. 37 illustrating the idler roller collapsing the flexible tubing.

FIG. 38 is a top view similar to FIG. 37 illustrating the idler roller 61 collapsing the flexible tube 13 against the compression surface 40. The resilient member 90 is in a partially compressed condition.

Figure 39:
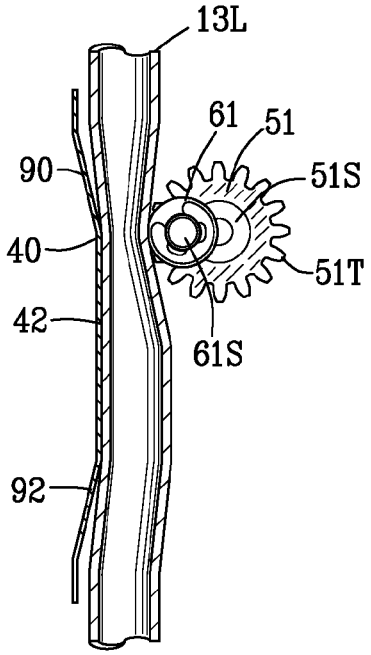
FIG. 39 is an enlarged view of a large flexible tubing disposed between a compression surface and an idler roller.
Figure 40:
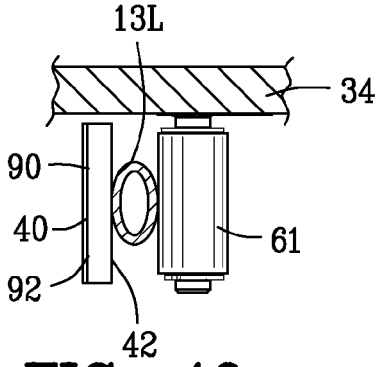
FIG. 40 is a top view of FIG. 39 illustrating the idler roller engaging the large flexible tubing.

FIGS. 39 and 40 are enlarged views of a large flexible tubing 13L disposed between the compression surface 40 and an idler roller 61. The resilient member 90 is in a partially compressed condition.

Figure 41:
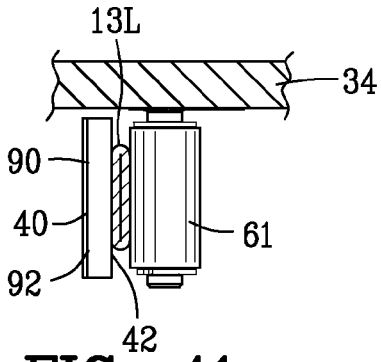
FIG. 41 is a top view similar to FIG. 40 illustrating the idler roller collapsing the large flexible tubing.

FIG. 41 is a top view similar to FIG. 40 illustrating the idler roller 61 collapsing the large flexible tube 13L against the compression surface 40. The resilient member 90 is in a more compressed condition. The resiliency of the resilient member 90 allows the improved linear peristaltic pump 10 of the present invention to be utilized with various sizes of flexible tubes with various sidewall thicknesses and form from various materials.

Although the invention has been described in its preferred form with a certain degree of particularity, it is understood that the present disclosure of the preferred form has been made only by way of example and that numerous changes in the details of construction and the combination and arrangement of parts may be resorted to without departing from the spirit and scope of the invention.

The invention claimed is:

1. A linear peristaltic pump for pumping a fluid through a flexible tube, comprising:

a central member mounted for rotation about a central shaft;

a plurality of planetary gears mounted by a plurality of planetary gear shafts to the central member respectively;

a ring gear in a mesh engagement with each of the plurality of planetary gears;

a roller located on each of the planetary gears offset from the planetary gear shafts respectively;

a generally flat compression surface located relative to the central axis for enabling the flexible tube to be inserted between the generally flat compression surface and at least one of the plurality of rollers; and a motor for effecting relative rotation between the central member and the ring gear for enabling the plurality of rollers to serially collapse the flexible tube and to move in a substantially linear motion along the generally flat compression surface for pumping the fluid through the flexible tube.

2. A linear peristaltic pump as set forth in claim 1, wherein the ring gear is an outer ring gear located outside of the plurality of planetary gears.

3. A linear peristaltic pump as set forth in claim 1, wherein the ring gear is an inner ring gear located inside of the plurality of planetary gears.

4. A linear peristaltic pump as set forth in claim 1, wherein the plurality of planetary gears are radially mounted about a periphery of the central member.

5. A linear peristaltic pump as set forth in claim 1, wherein each of the rollers is an idler roller.

6. A linear peristaltic pump as set forth in claim 1, wherein the motor rotates the central member relative to the ring gear.

7. A linear peristaltic pump as set forth in claim 1, including a motor drive connecting the motor to the central shaft for rotating the central shaft; and the central member mounted to the central shaft for rotation in accordance with the central shaft.

8. A linear peristaltic pump as set forth in claim 1, wherein the ring gear is fixed relative to the motor.

9. A linear peristaltic pump as set forth in claim 1, including a resilient member for accommodating minute non-linear motion of the plurality of rollers along the generally flat compression surface.

10. A linear peristaltic pump as set forth in claim 1, including a resilient member for accommodating minute non-linear motion of the plurality of rollers along the generally flat compression surface; and the resilient member comprising a resilient spring for biasing the generally flat compression surface toward the central shaft.

11. A linear peristaltic pump as set forth in claim 1, including a resilient member for accommodating minute non-linear motion of the plurality of rollers along the generally flat compression surface; and the resilient member comprising the flexible tube having a tube wall of sufficient thickness and sufficient resiliency accommodating for minute non-linear motion of the plurality of rollers along the generally flat compression surface.

12. A linear peristaltic pump as set forth in claim 1, including a pivot for pivotably mounting the generally flat compression surface is pivotably mounted between an open position and a closed position;

the open position enabling insertion and removal of flexible tube between the generally flat compression surface and at least one of the plurality of rollers, and the closed position effecting engagement between the generally flat compression surface and at least one of the plurality of rollers.

13. A linear peristaltic pump for pumping a fluid through a flexible tube, comprising:

a central member mounted for rotation about a central shaft;

a plurality of planetary gears mounted by a plurality of planetary gear shafts to the central member respectively;

an outer ring gear in a mesh engagement with each of the plurality of planetary gears;

a roller located on each of the planetary gears offset from the planetary gear shafts respectively;

a generally flat compression surface located relative to the central axis for enabling the flexible tube to be inserted between the generally flat compression surface and at least one of the plurality of rollers; and a motor for effecting relative rotation between the central member and the outer ring gear for enabling the plurality of rollers to serially collapse the flexible tube and to move in a substantially linear motion along the generally flat compression surface for pumping the fluid through the flexible tube.

14. A linear peristaltic pump for pumping a fluid through a flexible tube, comprising:

a central member mounted for rotation about a central shaft;

a plurality of planetary gears mounted by a plurality of planetary gear shafts to the central member respectively;

an outer ring gear in a mesh engagement with each of the plurality of planetary gears;

a roller mounted on each of the planetary gears and offset from the planetary gear shafts respectively;

a generally flat compression surface located relative to the central shaft for enabling the flexible tube to be inserted between the generally flat compression surface and at least one of the plurality of rollers;

a motor for effecting relative rotation between the central member and the outer ring gear for enabling the plurality of rollers to serially collapse the flexible tube against the generally flat compression surface and to move in a substantially linear motion along the generally flat compression surface for pumping the fluid through the flexible tube; and the flexible tube having a tube wall of sufficient thickness and sufficient resiliency for accommodating minute non-linear motion of said plurality of rollers along the generally flat compression surface for compensating for nonlinear motion of the plurality of rollers relative to the generally flat compression surface.

15. A dispenser system for a liquid located in a container with a flexible tube extending between a first and a second end with the first end communicating with the container and with a check valve located at the second end of the flexible tube, comprising:

a central member mounted for rotation about a central shaft;

a plurality of planetary gears mounted on a plurality of planetary gear shafts to the central member respectively;

an outer ring gear in a mesh engagement with each of the plurality of planetary gears;

a roller located on each of the planetary gears offset from the planetary gear shafts respectively;

a generally flat compression surface located relative to the central axis for enabling the flexible tube to be inserted between said generally flat compression surface and at least one of the plurality of rollers; and a motor for effecting relative rotation between the central member and the outer ring gear for enabling the plurality of rollers to serially collapse the flexible tube and to move in a substantially linear motion along the generally flat compression surface for pumping the fluid through the flexible tube.

16. A linear peristaltic pump for pumping a fluid through a flexible tube, comprising:

a central member mounted for rotation about a central shaft;

a plurality of planetary gears mounted by a plurality of planetary gear shafts to the central member respectively;

an inner ring gear in a mesh engagement with each of the plurality of planetary gears;

a roller located on each of the planetary gears offset from said planetary gear shafts respectively;

a generally flat compression surface located relative to the central axis for enabling the flexible tube to be inserted between the generally flat compression surface and at least one of the plurality of rollers; and a motor for effecting relative rotation between the central member and the inner ring gear for enabling the plurality of rollers to serially collapse the flexible tube and to move in a substantially linear motion along the generally flat compression surface for pumping the fluid through the flexible tube.

* * * * *